US009407987B2

(12) United States Patent
Li

(10) Patent No.: US 9,407,987 B2
(45) Date of Patent: Aug. 2, 2016

(54) AUDIO INTERFACE SELF-ADAPTATION DEVICE

(71) Applicant: Tendyron Corporation, Beijing (CN)

(72) Inventor: Dongsheng Li, Beijing (CN)

(73) Assignee: Tendyron Corporation, Beijing (CN)

( * ) Notice: Subject to any disclaimer, the term of this patent is extended or adjusted under 35 U.S.C. 154(b) by 60 days.

(21) Appl. No.: 14/407,529

(22) PCT Filed: Jun. 14, 2013

(86) PCT No.: PCT/CN2013/077077
§ 371 (c)(1),
(2) Date: Dec. 12, 2014

(87) PCT Pub. No.: WO2013/185592
PCT Pub. Date: Dec. 19, 2013

(65) Prior Publication Data

US 2015/0125005 A1 May 7, 2015

(30) Foreign Application Priority Data

Jun. 14, 2012 (CN) ..... 2012 1 0200188

(51) Int. Cl.
*H04R 3/00* (2006.01)
*H04R 5/04* (2006.01)

(52) U.S. Cl.
CPC .. *H04R 3/00* (2013.01); *H04R 5/04* (2013.01); *H04R 2201/107* (2013.01); *H04R 2420/05* (2013.01)

(58) Field of Classification Search
None
See application file for complete search history.

(56) References Cited

U.S. PATENT DOCUMENTS 8,155,337 B2 4/2012 Choi et al.
2011/0116646 A1* 5/2011 Sander ..... H04R 1/1083 381/71.6

FOREIGN PATENT DOCUMENTS

CN 101719610 A 6/2010
CN 102761803 A 10/2012
WO 2013185592 A1 12/2013

OTHER PUBLICATIONS

International Search Report corresponding to PCT/CN2013/077077, date mailed Sep. 19, 2013 (2 pages).

* cited by examiner

*Primary Examiner* — Curtis Kuntz
*Assistant Examiner* — Kenny Truong
(74) *Attorney, Agent, or Firm* — Maginot, Moore & Beck, LLP

(57) ABSTRACT

An audio interface self-adaption device includes an audio interface, a first level comparison module, a second level comparison module, a PNP triode Tc, a power output terminal VBAT, a switching module, a resistor R2*a*, and a resistor R2*b*. The audio interface includes a pin 1, a pin 2, a pin 3, and a pin 4. One of the pin 3 and the pin 4 is a microphone pin of the audio interface, and the other one of the pin 3 and the pin 4 is a ground pin. The switching module is configured to connect one of a first input pin B0L and a second input pin B1H of the switching module to an output pin of the switching module according to a level of a signal received by a signal input pin Sel of the switching module.

7 Claims, 9 Drawing Sheets

AUDIO INTERFACE SELF-ADAPTATION DEVICE

CROSS REFERENCE TO RELATED APPLICATIONS

This U.S. application claims priority under 35 U.S.C. 371 to, and is a U.S. National Phase application of, the International Patent Application No. PCT/CN2013/077077, filed Jun. 14, 2013, which claims the benefit of prior Chinese Application No. 201210200188.5 filed Jun. 14, 2012. The entire contents of the above-mentioned patent applications are incorporated by reference as part of the disclosure of this U.S. application.

FIELD

The present disclosure relates to an electronic technique field, and more particularly relates to an audio interface self-adaption device.

BACKGROUND

An audio interface (such as a headphone jack) of a conventional audio signal sending device (such as a mobile communication terminal) or an audio interface of a conventional audio interface receiving device (such as a headphone) is generally a four-section interface, where a pin 1 and a pin 2 are audio pins, namely a left-channel pin and a right-channel pin. As a pin 3 and a pin 4 have different functions in different audio interfaces, however, there are two types of audio interfaces. As one type, the pin 3 is a microphone pin (MIC pin) and the pin 4 is a ground pin (GND pin). As the other type, the pin 3 is a GND pin, and the pin 4 is a MIC pin.

As audio interfaces have the above different types, when an audio interface of an audio signal sending device (such as a mobile communication terminal) mismatches with an audio interface of an audio signal receiving device (such as a earphone or a headphone), the audio signal sending device and the audio signal receiving device can neither communicate with each other via the MIC pin of the audio interface, nor transmit audio signals between each other normally using the audio pins (a left-channel pin and a right channel-pin) of the audio interface.

Thus, an audio interface self-adaption device that can adapt to audio signal send devices (such as mobile communication terminals) having different audio interfaces is required.

SUMMARY

The technical problem the present disclosure seeks to solve is to overcome at least one disadvantages in the related art, and to provide an audio interface self-adaption device that can adapt to audio signal send devices having different audio interfaces.

In order to solve the above problems, an audio interface self-adaption device according to embodiments of the present disclosure is provided. The device comprises an audio interface comprising a pin 1, a pin 2, a pin 3, and a pin 4; one of the pin 3 and the pin 4 is a microphone pin of the audio interface, and the other one of the pin 3 and the pin 4 is a ground pin of the audio interface. The device further comprises a first level comparison module, a second level comparison module, a PNP triode Tc, a power output terminal VBAT, a switching module, a resistor R2*a*, and a resistor R2*b*, where:

the first level comparison module comprises a NPN triode Ta, and the NPN triode Ta comprises a base connected to a first pin, an emitter connected to a second pin, and a collector connected to a base of the PNP triode Tc via the resistor R2*a;* the second level comparison module comprises a NPN triode Tb, and the NPN triode Tb comprises a base connected to the second pin, an emitter connected to the first pin, and a collector connected to a signal input pin Sel of the switching module and connected to the base of the PNP triode Tc via the resistor R2*b;* an emitter of the PNP triode Tc is connected to the power output terminal VBAT, and a collector of the PNP triode Tc is connected to a power input pin VCC of the switching module;

the switching module is configured to connect one of the first input pin B0L and the second input pin B1H to the output pin of the switching module according to a level of a signal received by the signal input pin Sel;

an audio pin being the pin 1 and/or the pin 2 of the audio interface is connected to a ground wire; and the first pin is one of the pin 3 and the pin 4 of the audio interface, and the second pin is the other one of the pin 3 and the pin 4 of the audio interface.

In some embodiments, the device further comprises a first unidirectional conductive component, a second unidirectional conductive component, and a resistor R4; the audio pin is connected to the pin 3 via the first unidirectional conductive component, and the audio pin is connected to the pin 4 via the second unidirectional conductive component; a conducting direction of the first unidirectional conductive component is from the audio pin to the pin 3, and a conducting direction of the second unidirectional conductive component is from the audio pin to the pin 4; and the pin 3 and the pin 4 of the audio interface are connected via the resistor R4.

In some embodiments, the audio pin comprises the pin 1 and the pin 2 of the audio interface; the pin 1 is connected to the first unidirectional conductive component via a first signal processing module, the first unidirectional conductive component is connected to the pin 3, and the pin 1 is connected to the pin 4 via the first signal processing module and the second unidirectional conductive component; and the pin 2 is connected to the first unidirectional conductive component via a second signal processing module, the first unidirectional conductive component is connected to the pin 3, and the pin 2 is connected to the pin 4 via the second signal processing module and the second unidirectional conductive component.

In some embodiments, the first unidirectional conductive component comprises one selected from a group consisting of: a diode, a triode, and a MOS; and the second unidirectional conductive component comprises one selected from a group consisting of: a diode, a triode, and a MOS.

In some embodiments, the first signal processing module comprises at least one selected from a group consisting of: a resistor, a microphone, a transformer, a resistor, and a comparator connected in parallel, and a resistor and an operational amplifier connected in parallel; and the second signal processing module comprises at least one selected from a group consisting of: a resistor, a microphone, a transformer, a resistor and a comparator connected in parallel, and a resistor and an operational amplifier connected in parallel.

In some embodiments, the audio interface is a headphone plug or a headphone jack.

Embodiments of the present disclosure provide an audio interface self-adaption device. The device comprises an audio interface; the audio interface comprises a pin 1, a pin 2, a pin 3, and a pin 4; one of the pin 3 and the pin 4 is a microphone pin of the audio interface, and the other one of the pin 3 and the pin 4 is a ground pin of the audio interface. The device further comprises a first level comparison module, a second level comparison module, a PNP triode Tc, a power output terminal VBAT, a switching module, a resistor R2*a*, and a resistor R2*b*; where:

the first level comparison module comprises a first reference voltage module H1 and a comparator C1;

a positive electrode of the comparator C1 is connected to a second pin, a negative electrode of the first reference voltage module H1 is connected to a first pin, a positive electrode of the first reference voltage module H1 is connected to a negative electrode of the comparator C1, and an output pin of the comparator C1 is connected to a base of the PNP triode Tc via the resistor R2*a;* the second level comparison module comprises a second reference voltage module H2 and a comparator C2;

a negative electrode of the comparator C2 is connected to the second pin, a positive electrode of the second reference voltage module H2 is connected to the first pin, a negative electrode of the second reference voltage module H2 is connected to the positive electrode of the comparator C2, and an output pin of the comparator C2 is connected to a signal input pin Sel of the switching module, and the output pin of the comparator C2 is connected to the base of the PNP triode Tc via the resistor R2*b;* a first input pin B0L of the switching module is connected to the first pin, a second input pin B1H of the switching module is connected to the second pin, and an output pin of the switching module is connected to the ground;

the switching module is configured to connect one of the first input pin B0L and the second input pin B1H to the output pin of the switching module according to a level of a signal received by the signal input pin Sel;

an audio pin being the pin 1 and/or the pin 2 of the audio interface is connected to a ground wire; and the first pin is one of the pin 3 and the pin 4 of the audio interface, and the second pin is the other one of the pin 3 and the pin 4 of the audio interface.

In some embodiments, the device further comprises a first unidirectional conductive component, a second unidirectional conductive component, and a resistor R4; the audio pin is connected to the pin 3 via the first unidirectional conductive component, and the audio pin is connected to the pin 4 via the second unidirectional conductive component; a conducting direction of the first unidirectional conductive component is from the audio pin to the pin 3, and a conducting direction of the second unidirectional conductive component is from the audio pin to the pin 4; and the pin 3 and the pin 4 of the audio interface are connected via the resistor R4.

In some embodiments, the audio pin is the pin 1 and the pin 2 of the audio interface; the pin 1 is connected to the first unidirectional conductive component via a first signal processing module, the first unidirectional conductive component is connected to the pin 3, and the pin 1 is connected to the pin 4 via the first signal processing module and the second unidirectional conductive component; and the pin 2 is connected to the first unidirectional conductive component via a second signal processing module, the first unidirectional conductive component is connected to the pin 3, and the pin 2 is connected to the pin 4 via the second signal processing module and the second unidirectional conductive component.

In some embodiments, the first unidirectional conductive component comprises one selected from a group consisting of: a diode, a triode, and a MOS; and the second unidirectional conductive component comprises one selected from a group consisting of: a diode, a triode, and a MOS.

In some embodiments, the first signal processing module comprises at least one selected from a group consisting of: a resistor, a microphone, a transformer, a resistor and a comparator connected in parallel, and a resistor and an operational amplifier connected in parallel; and the second signal processing module comprises at least one selected from a group consisting of: a resistor, a microphone, a transformer, a resistor and a comparator connected in parallel, and a resistor and an operational amplifier connected in parallel.

In some embodiments, the audio interface is a headphone plug or a headphone jack.

Embodiments of the present disclosure provide an audio interface self-adaption device. The device comprises an audio interface; the audio interface comprises a pin 1, a pin 2, a pin 3, and a pin 4; one of the pin 3 and the pin 4 is a microphone pin of the audio interface, and the other one of the pin 3 and the pin 4 is a ground pin of the audio interface. The device further comprises a first level comparison module, a second level comparison module, a PNP triode Tc, a power output terminal VBAT, a switching module, a resistor R2*a*, and a resistor R2*b*; where:

the first level comparison module comprises a NPN triode Ta;

the NPN triode Ta comprises a base connected to a first pin, an emitter connected to a second pin, and a collector connected to a base of the PNP triode Tc via the resistor R2*a;* the second level comparison module comprises a second reference voltage module H2 and a comparator C2;

a negative electrode of the comparator C2 is connected to the second pin, a positive electrode of the second reference voltage module H2 is connected to the first pin, a negative electrode of the second reference voltage module H2 is connected to a positive electrode of the comparator C2, an output pin of the comparator C2 is connected to a signal input pin Sel of the switching module, and the output pin of the comparator C2 is connected to the base of the PNP triode Tc via the resistor R2*b;* an emitter of the PNP triode Tc is connected to the power output terminal VBAT, and a collector of the PNP triode Tc is connected to a power input pin VCC of the switching module;

a first input pin B0L of the switching module is connected to the first pin, a second input pin B1H of the switching module is connected to the second pin, and an output pin of the switching module is connected to the ground;

the switching module is configured to connect one of the first input pin B0L and the second input pin B1H to the output pin of the switching module according to a level of a signal received by the signal input pin Sel;

an audio pin being the pin 1 and/or the pin 2 of the audio interface is connected to a ground wire; and the first pin is one of the pin 3 and the pin 4 of the audio interface, and the second pin is the other one of the pin 3 and the pin 4 of the audio interface.

In some embodiments, the device further comprises a first unidirectional conductive component, a second unidirectional conductive component, and a resistor R4; the audio pin is connected to the pin 3 via the first unidirectional conductive component, and the audio pin is connected to the pin 4 via the second unidirectional conductive component; a conducting direction of the first unidirectional conductive component is from the audio pin to the pin 3, and a conducting direction of the second unidirectional conductive component is from the audio pin to the pin 4; and the pin 3 and the pin 4 of the audio interface are connected via the resistor R4.

In some embodiments, the audio pin is the pin 1 and the pin 2 of the audio interface; the pin 1 is connected to the first unidirectional conductive component via a first signal processing module, the first unidirectional conductive component is connected to the pin 3, and the pin 1 is connected to the pin 4 via the first signal processing module and the second unidirectional conductive component; and the pin 2 is connected to the first unidirectional conductive component via a second signal processing module, the first unidirectional conductive component is connected to the pin 3, and the pin 2 is connected to the pin 4 via the second signal processing module and the second unidirectional conductive component.

In some embodiments, the first unidirectional conductive component comprises one selected from a group consisting of: a diode, a triode, and a MOS; and the second unidirectional conductive component comprises one selected from a group consisting of: a diode, a triode, and a MOS.

In some embodiments, the first signal processing module comprises at least one selected from a group consisting of: a resistor, a microphone, a transformer, a resistor and a comparator connected in parallel, and a resistor and an operational amplifier connected in parallel; and the second signal processing module comprises at least one selected from a group consisting of: a resistor, a microphone, a transformer, a resistor and a comparator connected in parallel, and a resistor and an operational amplifier connected in parallel.

In some embodiments, the audio interface is a headphone plug or a headphone jack.

Embodiments of the present disclosure provide an audio interface self-adaption device. The device comprises an audio interface; the audio interface comprises a pin 1, a pin 2, a pin 3, and a pin 4; one of the pin 3 and the pin 4 is a microphone pin of the audio interface, and the other one of the pin 3 and the pin 4 is a ground pin of the audio interface. The device further comprises a first level comparison module, a second level comparison module, a PNP triode Tc, a power output terminal VBAT, a switching module, a resistor R2*a*, and a resistor R2*b*, where:

the first level comparison module comprises a first reference voltage module H1 and a comparator C1;

a positive electrode of the comparator C1 is connected to a first pin, a negative electrode of the first reference voltage module H1 is connected to a second pin, a positive electrode of the first reference voltage module H1 is connected to a negative electrode of the comparator C1, and an output pin of the comparator C1 is connected to a base of the PNP triode Tc via the resistor R2*a;* the second level comparison module comprises a NPN triode Tb;

the NPN triode Tb comprises a base connected to the first pin, an emitter connected to the second pin, and a collector connected to a signal input pin Sel of the switching module and connected to the base of the PNP triode Tc via the resistor R2*b;* an emitter of the PNP triode Tc is connected to the power output terminal VBAT, and a collector of the PNP triode Tc is connected to a power input pin VCC of the switching module;

a first input pin B0L of the switching module is connected to the second pin, a second input pin B1H of the switching module is connected to the first pin, and an output pin of the switching module is connected to the ground;

the switching module is configured to connect one of the first input pin B0L and the second input pin B1H to the output pin of the switching module according to a level of a signal received by the signal input pin Sel;

an audio pin being the pin 1 and/or the pin 2 of the audio interface is connected to a ground wire; and the first pin is one of the pin 3 and the pin 4 of the audio interface, and the second pin is the other one of the pin 3 and the pin 4 of the audio interface.

In some embodiments, the device further comprises a first unidirectional conductive component, a second unidirectional conductive component, and a resistor R4; the audio pin is connected to the pin 3 via the first unidirectional conductive component, and the audio pin is connected to the pin 4 via the second unidirectional conductive component; a conducting direction of the first unidirectional conductive component is from the audio pin to the pin 3, and a conducting direction of the second unidirectional conductive component is from the audio pin to the pin 4; and the pin 3 and the pin 4 of the audio interface are connected via the resistor R4.

In some embodiments, the audio pin is the pin 1 and the pin 2 of the audio interface; the pin 1 is connected to the first unidirectional conductive component via a first signal processing module, the first unidirectional conductive component is connected to the pin 3, and the pin 1 is connected to the pin 4 via the first signal processing module and the second unidirectional conductive component; and the pin 2 is connected to the first unidirectional conductive component via a second signal processing module, the first unidirectional conductive component is connected to the pin 3, and the pin 2 is connected to the pin 4 via the second signal processing module and the second unidirectional conductive component.

In some embodiments, the first unidirectional conductive component comprises one selected from a group consisting of: a diode, a triode, and a MOS; and the second unidirectional conductive component comprises one selected from a group consisting of: a diode, a triode, and a MOS.

In some embodiments, the first signal processing module comprises at least one selected from a group consisting of: a resistor, a microphone, a transformer, a resistor and a comparator connected in parallel, and a resistor and an operational amplifier connected in parallel; and the second signal processing module comprises at least one selected from a group consisting of: a resistor, a microphone, a transformer, a resistor and a comparator connected in parallel, and a resistor and an operational amplifier connected in parallel.

In some embodiments, the audio interface is a headphone plug or a headphone jack.

Embodiments of the present disclosure provide an audio interface self-adaption device. The device comprises an audio interface; the audio interface comprises a pin 1, a pin 2, a pin 3 and a pin 4; one of the pin 3 and the pin 4 is a microphone pin of the audio interface, and the other one of the pin 3 and the pin 4 is a ground pin of the audio interface. The device further comprises a first level comparison module, a second level comparison module, a power output terminal VBAT, a first switching module, a second switching module, and a resistor R2*a*, a resistor R2*b*, a resistor R3*a*, and a resistor R3*b*; where:

the first level comparison module comprises a NPN triode Ta, and the NPN triode Ta of the first level comparison module comprises a base connected to a first pin, an emitter connected to a second pin, and a collector connected to the power output terminal VBAT via the resistor R2*a* and the resistor R3*a* and connected to a signal input pin Sel1 of the first switching module;

the second level comparison module comprises a NPN triode Tb, and the NPN triode Tb of the second level comparison module comprises a base connected to the second pin, an emitter connected to the first pin, and a collector connected to the power output terminal VBAT via the resistor R2*b* and the resistor R3*b* and connected to a signal input pin Sel2 of the second switching module;

a first input pin B0L of the first switching module is connected to the first pin, a first input pin B0L of the second switching module is connected to the second pin; or, a second input pin B1H of the first switching module is connected to the second pin, and a second input pin B1H of the second switching module is connected to the first pin; and an output pin of the first switching module is connected to the ground, and an output pin of the second switching module is connected to the ground;

the first switching module is configured to connect the first input pin B0L of the first switching module to the output pin of the first switching module according to a low level signal received by the signal input pin Sel1; the second switching module is configured to connect the first input pin B0L of the second switching module to the output pin of the second switching module according to a low level signal received by the signal input pin Sel2; the first switching module is configured to connect the second input pin B1H of the first switching module to the output pin of the first switching module according to a high level signal received by the signal input pin Sel1; and the second switching module is configured to connect the second input pin B1H of the second switching module to the output pin of the second switching module according to a high level signal received by the signal input pin Sel2;

an audio pin being the pin 1 and/or the pin 2 of the audio interface is connected to a ground wire; and the first pin is one of the pin 3 and the pin 4 of the audio interface, and the second pin is the other one of the pin 3 and the pin 4 of the audio interface.

In some embodiments, the device further comprises a first unidirectional conductive component, a second unidirectional conductive component, and a resistor R4; the audio pin is connected to the pin 3 via the first unidirectional conductive component, and the audio pin is connected to the pin 4 via the second unidirectional conductive component; a conducting direction of the first unidirectional conductive component is from the audio pin to the pin 3, and a conducting direction of the second unidirectional conductive component is from the audio pin to the pin 4; and the pin 3 and the pin 4 of the audio interface are connected via the resistor R4.

In some embodiments, the audio pin is the pin 1 and the pin 2 of the audio interface; the pin 1 is connected to the first unidirectional conductive component via a first signal processing module, the first unidirectional conductive component is connected to the pin 3, and the pin 1 is connected to the pin 4 via the first signal processing module and the second unidirectional conductive component; and the pin 2 is connected to the first unidirectional conductive component via a second signal processing module, the first unidirectional conductive component is connected to the pin 3, and the pin 2 is connected to the pin 4 via the second signal processing module and the second unidirectional conductive component.

In some embodiments, the first unidirectional conductive component comprises one selected from a group consisting of: a diode, a triode, and a MOS; and the second unidirectional conductive component comprises one selected from a group consisting of: a diode, a triode, and a MOS.

In some embodiments, the first signal processing module comprises at least one selected from a group consisting of: a resistor, a microphone, a transformer, a resistor and a comparator connected in parallel, and a resistor and an operational amplifier connected in parallel; and the second signal processing module comprises at least one selected from a group consisting of: a resistor, a microphone, a transformer, a resistor and a comparator connected in parallel, and a resistor and an operational amplifier connected in parallel.

In some embodiments, the audio interface is a headphone plug or a headphone jack.

Embodiments of the present disclosure provide an audio interface self-adaption device. The device comprises an audio interface; the audio interface comprises a pin 1, a pin 2, a pin 3, and a pin 4; one of the pin 3 and the pin 4 is a microphone pin of the audio interface, and the other one of the pin 3 and the pin 4 is a ground pin. The device further comprises a first level comparison module, a second level comparison module, a power output terminal VBAT, a first switching module, and a second switching module; where:

the first level comparison module comprises a first reference voltage module H1 and a comparator C1;

a positive electrode of the comparator C1 is connected to a second pin; a negative electrode of the first reference voltage module H1 is connected to a first pin; a positive electrode of the first reference voltage module H1 is connected to a negative electrode of the comparator C1; and an output pin of the comparator C1 is connected to a signal input pin Sel1 of the first switching module;

the second level comparison module comprises a second reference voltage module H2 and a comparator C2;

a negative electrode of the comparator C2 is connected to the second pin; a positive electrode of the second reference voltage module H2 is connected to the first pin; a negative electrode of the second reference voltage module H2 is connected to a positive electrode of the comparator C2; and an output pin of the comparator C2 is connected to a signal input pin Sel2 of the second switching module;

a first input pin B0L of the first switching module is connected to the first pin, a first input pin B0L of the second switching module is connected to the second pin; or, a second input pin B1H of the first switching module is connected to the second pin, a second input pin B1H of the second switching module is connected to the first pin; and an output pin of the first switching module is connected to the ground, and an output pin of the second switching module is connected to the ground;

the first switching module is configured to connect the first input pin B0L of the first switching module to the output pin of the first switching module according to a low level signal received by the signal input pin Sel1; the second switching module is configured to connect the first input pin B0L of the second switching module to the output pin of the second switching module according to a low level signal received by the signal input pin Sel2; the first switching module is configured to connect the second input pin B1H of the first switching module to the output pin of the first switching module according to a high level signal received by the signal input pin Sel1; the second switching module is configured to connect the second input pin B1H of the second switching module to the output pin of the second switching module according to a high level signal received by the signal input pin Sel2;

an audio pin being the pin 1 and/or the pin 2 of the audio interface is connected to a ground wire; and the first pin is one of the pin 3 and the pin 4 of the audio interface, and the second pin is the other one of the pin 3 and the pin 4.

In some embodiments, the device further comprises a first unidirectional conductive component, a second unidirectional conductive component, and a resistor R4; the audio pin is connected to the pin 3 via the first unidirectional conductive component, and the audio pin is connected to the pin 4 via the second unidirectional conductive component; a conducting direction of the first unidirectional conductive component is from the audio pin to the pin 3, and a conducting direction of the second unidirectional conductive component is from the audio pin to the pin 4; and the pin 3 and the pin 4 of the audio interface are connected via the resistor R4.

In some embodiments, the audio pin comprises the pin 1 and the pin 2 of the audio interface; the pin 1 is connected to the first unidirectional conductive component via a first signal processing module, the first unidirectional conductive component is connected to the pin 3, and the pin 1 is connected to the pin 4 via the first signal processing module and the second unidirectional conductive component; and the pin 2 is connected to the first unidirectional conductive component via a second signal processing module, the first unidirectional conductive component is connected to the pin 3, and the pin 2 is connected to the pin 4 via the second signal processing module and the second unidirectional conductive component.

In some embodiments, the first unidirectional conductive component comprises one selected from a group consisting of: a diode, a triode, and a MOS; and the second unidirectional conductive component comprises one selected from a group consisting of: a diode, a triode, and a MOS.

In some embodiments, the first signal processing module comprises at least one selected from a group consisting of: a resistor, a microphone, a transformer, a resistor and a comparator connected in parallel, and a resistor and an operational amplifier connected in parallel; and the second signal processing module comprises at least one selected from a group consisting of: a resistor, a microphone, a transformer, a resistor and a comparator connected in parallel, and a resistor and an operational amplifier connected in parallel.

In some embodiments, the audio interface is a headphone plug or a headphone jack.

Embodiments of the present disclosure provide an audio interface self-adaption device. The device comprises an audio interface; the audio interface comprises a pin 1, a pin 2, a pin 3, and a pin 4; one of the pin 3 and the pin 4 is a microphone pin of the audio interface, and the other one of the pin 3 and the pin 4 is a ground pin of the audio interface. The device further comprises a first level comparison module, a second level comparison module, a power output terminal VBAT, a first switching module, a second switching module, a resistor R2*a*, and a resistor R3*a*; where:

the first level comparison module comprises a NPN triode Ta;

the NPN triode Ta comprises a base connected to a first pin, an emitter connected to a second pin, and a collector connected to the power output terminal VBAT via the resistor R2*a* and the resistor R3*a* and connected to a signal input pin Sel1 of the first switching module via the resistor R2*a;* the second level comparison module comprises a second reference voltage module H2 and a comparator C2;

a negative electrode of the comparator C2 is connected to the second pin; a positive electrode of the second reference voltage module H2 is connected to the first pin; a negative electrode of the second reference voltage module H2 is connected to a positive electrode of the comparator C2; an output pin of the comparator C2 is connected to a signal input pin Sel2 of the second switching module;

a first input pin B0L of the first switching module is connected to the first pin, a first input pin B0L of the second switching module is connected to the second pin; or, a second input pin B1H of the first switching module is connected to the second pin, a second input pin B1H of the second switching module is connected to the first pin; and an output pin of the first switching module is connected to the ground, and an output pin of the second switching module is connected to the ground;

the first switching module is configured to connect the first input pin B0L of the first switching module to the output pin of the first switching module according to the a low level signal received by the signal input pin Sel1; the second switching module is configured to connect the first input pin B0L of the second switching module to the output pin of the second switching module according to a low level signal received by the signal input pin Sel2; the first switching module is configured to connect the second input pin B1H of the first switching module to the output pin of the first switching module according to a high level signal received by the signal input pin Sel1; and the second switching module is configured to connect the second input pin B1H of the second switching module to the output pin of the second switching module according to a high level signal received by the signal input pin Sel2;

an audio pin being the pin 1 and/or the pin 2 of the audio interface is connected to a ground wire, and the first pin is one of the pin 3 and the pin 4 of the audio interface, and the second pin is the other one of the pin 3 and the pin 4.

In some embodiments, the device further comprises a first unidirectional conductive component, a second unidirectional conductive component, and a resistor R4; the audio pin is connected to the pin 3 via the first unidirectional conductive component, and the audio pin is connected to the pin 4 via the second unidirectional conductive component; a conducting direction of the first unidirectional conductive component is from the audio pin to the pin 3, and a conducting direction of the second unidirectional conductive component is from the audio pin to the pin 4; and the pin 3 and the pin 4 of the audio interface are connected via the resistor R4.

In some embodiments, the audio pin is the pin 1 and the pin 2 of the audio interface; the pin 1 is connected to the first unidirectional conductive component via a first signal processing module, the first unidirectional conductive component is connected to the pin 3, and the pin 1 is connected to the pin 4 via the first signal processing module and the second unidirectional conductive component; and the pin 2 is connected to the first unidirectional conductive component via a second signal processing module, the first unidirectional conductive component is connected to the pin 3, and the pin 2 is connected to the pin 4 via the second signal processing module and the second unidirectional conductive component.

In some embodiments, the first unidirectional conductive component comprises one selected from a group consisting of: a diode, a triode, and a MOS; and the second unidirectional conductive component comprises one selected from a group consisting of: a diode, a triode, and a MOS.

In some embodiments, the first signal processing module comprises at least one selected from a group consisting of: a resistor, a microphone, a transformer, a resistor and a comparator connected in parallel, and a resistor and an operational amplifier connected in parallel; and the second signal processing module comprises at least one selected from a group consisting of: a resistor, a microphone, a transformer, a resistor and a comparator connected in parallel, and a resistor and an operational amplifier connected in parallel.

In some embodiments, the audio interface is a headphone plug or a headphone jack.

Embodiments of the present disclosure provide an audio interface self-adaption device. The device comprises an audio interface; the audio interface comprising a pin 1, a pin 2, a pin 3, and a pin 4; one of the pin 3 and the pin 4 is a microphone pin of the audio interface, and the other one of the pin 3 and the pin 4 is a ground pin of the audio interface. The device further comprises a first level comparison module, a second level comparison module, a power output terminal VBAT, a first switching module, a second switching module, a resistor R2*b*, and a resistor R3*b*; where:

the first level comparison module comprises a first reference voltage module H1 and a comparator C1;

a positive electrode of the comparator C1 is connected to a first pin; a negative electrode of the first reference voltage module H1 is connected to a second pin; a positive electrode of the first reference voltage module H1 is connected to a negative electrode of the comparator C1; an output pin of the comparator C1 is connected to a signal input pin Sel1 of the first switching module;

the second level comparison module comprises a NPN triode Tb;

the NPN triode Tb comprises a base connected to the first pin, an emitter connected to the second pin, and a collector connected to the power output terminal VBAT via the resistor R2*b* and the resistor R3*b* and connected to a signal input pin Sel2 of the second switching module via the resistor R2*b;* a first input pin B0L of the first switching module is connected to the first pin, a first input pin B0L of the second switching module is connected to the second pin; or, a second input pin B1H of the first switching module is connected to the second pin, a second input pin B1H of the second switching module is connected to the first pin; and an output pin of the first switching module is connected to the ground, and an output pin of the second switching module is connected to the ground;

the first switching module is configured to connect the first input pin B0L of the first switching module to the output pin of the first switching module according to the a low level signal received by the signal input pin Sel1; the second switching module is configured to connect the first input pin B0L of the second switching module to the output pin of the second switching module according to a low level signal received by the signal input pin Sel2; the first switching module is configured to connect the second input pin B1H of the first switching module to the output pin of the first switching module according to a high level signal received by the signal input pin Sel1; the second switching module is configured to connect the second input pin B1H of the second switching module to the output pin of the second switching module according to a high level signal received by the signal input pin Sel2;

an audio pin being the pin 1 and/or the pin 2 of the audio interface is connected to a ground wire; and the first pin is one of the pin 3 and the pin 4 of the audio interface, and the second pin is the other one of the pin 3 and the pin 4.

In some embodiments, the device further comprises a first unidirectional conductive component, a second unidirectional conductive component, and a resistor R4; the audio pin is connected to the pin 3 via the first unidirectional conductive component, and the audio pin is connected to the pin 4 via the second unidirectional conductive component; a conducting direction of the first unidirectional conductive component is from the audio pin to the pin 3, and a conducting direction of the second unidirectional conductive component is from the audio pin to the pin 4; and the pin 3 and the pin 4 of the audio interface are connected via the resistor R4.

In some embodiments, the audio pin comprises the pin 1 and the pin 2 of the audio interface; the pin 1 is connected to the first unidirectional conductive component via a first signal processing module, the first unidirectional conductive component is connected to the pin 3, and the pin 1 is connected to the pin 4 via the first signal processing module and the second unidirectional conductive component; the pin 2 is connected to the first unidirectional conductive component via a second signal processing module, the first unidirectional conductive component is connected to the pin 3, and the pin 2 is connected to the pin 4 via the second signal processing module and the second unidirectional conductive component.

In some embodiments, the first unidirectional conductive component comprises one selected from a group consisting of: a diode, a triode, and a MOS; and the second unidirectional conductive component comprises one selected from a group consisting of: a diode, a triode, and a MOS.

In some embodiments, the first signal processing module comprises at least one selected from a group consisting of: a resistor, a microphone, a transformer, a resistor and a comparator connected in parallel, and a resistor and an operational amplifier connected in parallel; and the second signal processing module comprises at least one selected from a group consisting of: a resistor, a microphone, a transformer, a resistor and a comparator connected in parallel, and a resistor and an operational amplifier connected in parallel.

In some embodiments, the audio interface is a headphone plug or a headphone jack.

Embodiments of the present disclosure provide an audio interface self-adaption device. The device comprises an audio interface; the audio interface comprises a pin 1, a pin 2, a pin 3, and a pin 4; one of the pin 3 and the pin 4 is a microphone pin of the audio interface, and the other one of the pin 3 and the pin 4 is a ground pin of the audio interface. The device further comprises a level comparison module and an earthed switching module; where the level comparison module is configured to detect levels of the pin 3 and the pin 4 of the audio interface and to output a control instruction for controlling the earthed switching module according to the detected levels; and the earthed switching module is configured to connect a GND pin being the pin 3 or the pin 4 of the audio interface to the ground according to the control instruction.

In some embodiments, the level comparison module comprises a first level comparison module and a second level comparison module.

In some embodiments, the first level comparison module comprises a triode or a comparator; and the second level comparison module comprises a triode or a comparator.

In some embodiments, the earthed switching module comprises a switching module, and the switching module is configured to receive a control instruction output by the first level comparison module or the second level comparison module after the levels of the pin 3 and the pin 4 of the audio interface are detected by the first level comparison module or the second level comparison module.

In some embodiments, the switching module further comprises a delay switching module configured to delay powering on the switching module.

In some embodiments, the earthed switching module comprises a first switching module and/or a second switching module; the first switching module is configured to receive a control instruction output by the first level comparison module after the levels of the pin 3 and the pin 4 of the audio interface are detected by the first level comparison module; and the second switching module is configured to receive the control instruction output by the second level comparison module after the levels of the pin 3 and the pin 4 of the audio interface are detected by the second level comparison module.

In some embodiments, an audio pin being the pin 1 and/or the pin 2 of the audio interface is connected to a ground wire; the device further comprises a first unidirectional conductive component, a second unidirectional conductive component, and a resistor R4; the audio pin is connected to the pin 3 via the first unidirectional conductive component, and the audio pin is connected to the pin 4 via the second unidirectional conductive component; a conducting direction of the first unidirectional conductive component is from the audio pin to the pin 3, and a conducting direction of the second unidirectional conductive component is from the audio pin to the pin 4; and the pin 3 and the pin 4 of the audio interface are connected via the resistor R4.

In some embodiments, the audio pin comprises the pin 1 and the pin 2 of the audio interface; the pin 1 is connected to the first unidirectional conductive component via a first signal processing module, the first unidirectional conductive component is connected to the pin 3, and the pin 1 is connected to the pin 4 via the first signal processing module and the second unidirectional conductive component; and the pin 2 is connected to the first unidirectional conductive component via a second signal processing module, the first unidirectional conductive component is connected to the pin 3, and the pin 2 is connected to the pin 4 via the second signal processing module and the second unidirectional conductive component.

In some embodiments, the first unidirectional conductive component comprises one selected from a group consisting of: a diode, a triode, and a MOS; and the second unidirectional conductive component comprises one selected from a group consisting of: a diode, a triode, and a MOS.

In some embodiments, the first signal processing module comprises at least one selected from a group consisting of: a resistor, a microphone, a transformer, a resistor and a comparator connected in parallel, and a resistor and an operational amplifier connected in parallel; and the second signal processing module comprises at least one selected from a group consisting of: a resistor, a microphone, a transformer, a resistor and a comparator connected in parallel, and a resistor and an operational amplifier connected in parallel.

In some embodiments, the audio interface is a headphone plug or a headphone jack.

The audio interface self-adaption device according to embodiments of the present disclosure may adapt to audio signal sending devices having different audio interfaces automatically at a lower cost, and successfully pass a detection conducted by the audio signal sending device when an audio device connected to the audio interface self-adaption device is detecting a MIC pin of the audio interface (i.e. supplying an offset voltage to the MIC pin).

DETAILED DESCRIPTION

Figure 1:
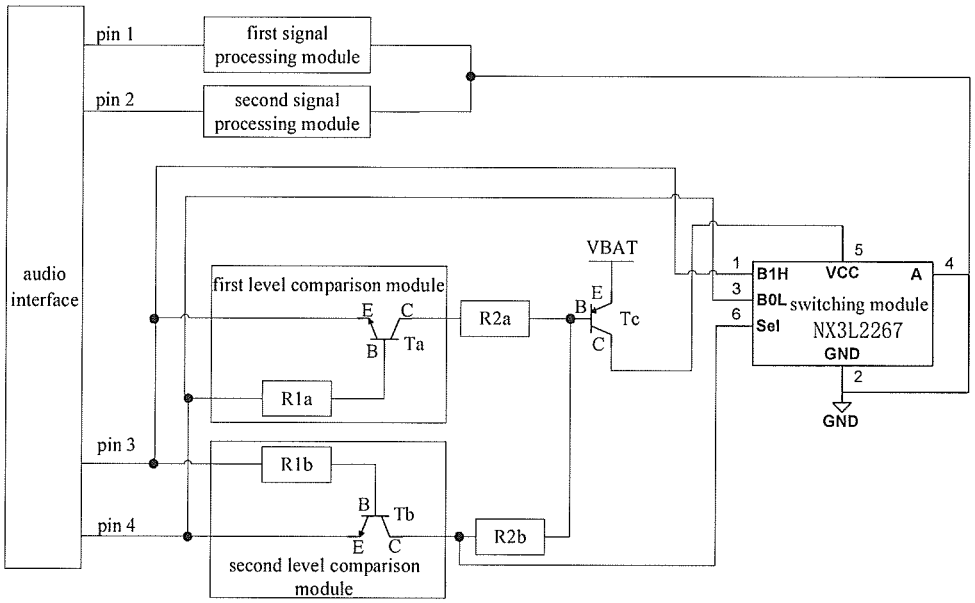
FIG. 1 is a schematic view of an audio interface self-adaption device according to a first embodiment of the present disclosure.

In the following, the present disclosure is described in detail with reference to embodiments in connection with the drawings.

An audio interface self-adaption device according to embodiments of the present disclosure comprises an audio pin (such as a pin 1, a pin 2), a pin 3, and a pin 4. The pin 1 and the pin 2 are audio pins which may be a left-channel pin and a right-channel pin respectively. According to different audio interface standards, the pin 3 may be a MIC pin, and the pin 4 may be a GND pin; or the pin 3 may be a GND pin, and the pin 4 may be a MIC pin.

The audio interface of the audio interface self-adaption device according to embodiments of the present disclosure can be any four-section headphone plug or four-section headphone jack, such as a headphone plug with a diameter of 3.5 mm or 2.5 mm or a headphone jack with a diameter of 3.5 mm or 2.5 mm.

If the audio interface of the audio interface self-adaption device according to embodiments of the present disclosure is a headphone plug, the audio interface of the audio interface self-adaption device according to embodiments of the present disclosure can be inserted into a headphone jack of an audio signal sending device (such as a smart phone) directly. If the audio interface of the audio interface self-adaption device of the audio interface self-adaption device according to embodiments of the present disclosure is a headphone jack, the audio interface self-adaption device can be connected to a headphone jack of a smart phone via a tieline having two terminals configured as headphone jacks.

Of course, the switching module of the audio interface self-adaption device according to embodiments of the present disclosure may be a switch such as a NX3L2267 switch, a STG3682QTR switch, or an AOZ6184 switch.

Embodiment 1

FIG. 1 is a schematic view of an audio interface self-adaption device according to a first embodiment of the present disclosure. As shown in FIG. 1, the audio interface self-adaption device of the embodiment comprises: an audio interface, a first level comparison module, a second level comparison module, a triode Tc, a power output terminal VBAT, a switching module, a resistor R2*a*, a resistor R2*b*, and so on.

The first level comparison module comprises a triode Ta, and the second level comparison module comprises a triode Tb.

The triode Ta is a NPN triode, the triode Tb is a NPN triode, and the triode Tc is a PNP triode.

A base (B) of the triode Ta is connected to the pin 4, an emitter (E) of the triode Ta is connected to the pin 3, and a collector (C) of the triode Ta is connected to a base (B) of the triode Tc via the resistor R2*a*.

Furthermore, the base (B) of the triode Ta may be connected to the pin 4 via a resistor R1*a*.

A base (B) of the triode Tb is connected to the pin 3, an emitter (E) of the triode Tb is connected to the pin 4, and a collector (C) of the triode Tb is connected to a signal input pin (Sel) of the switching module, and the collector (C) of the triode Tb is connected to the base (B) of the triode Tc via the resistor R2*b*.

Moreover, the base (B) of the triode Tb and the pin 3 may be connected via a resistor R1*b*.

Each of the resistor R1*a*, the resistor R2*a*, the resistor Rib, and the resistor R2*b* has a resistance from 1KΩ to 1 MΩ.

An emitter (E) of the triode Tc is connected to the power output terminal VBAT, and a collector (C) of the triode Tc is connected to a power input pin (VCC) of the switching module.

If an ordinary battery is used as the power, a voltage output by the power is generally from 2.7V to 4.2V.

A B0L pin (may be called a first input pin) of the switching module is connected to the pin 4 of the audio interface, a B1H pin (may be called a second input pin) of the switching module is connected to the pin 3 of the audio interface, a ground pin (GND pin) of the switching module is connected to the ground, and a pin A (may be called an output pin) of the switching module is connected to the ground and to the pin 1 and the pin 2 of the audio interface.

Furthermore, the pin 1 of the audio interface may be connected to a ground wire via a first signal processing module, and the pin 2 of the audio interface may be connected to the ground wire via a second signal processing module.

Each of the first signal processing module and the second signal processing module may comprise at least one selected from a group consisting of: a resistor, a louder speaker, a transformer, and a signal processing module comprising a resistor and a comparator connected in parallel.

In the embodiment, when a level $V_3$ of the pin 3 is greater than a sum of a level $V_4$ of the pin 4 and a predetermined threshold $V_g$ (i.e. $V_3>V_4+V_g$), the triode Ta is in an OFF state, the triode Tb is in an ON state, and the triode Tc is in an ON state. The VBAT supplies power to the switching module via the VCC and a low level signal is received by the Sel pin of the switching module, which indicates the pin 3 is the MIC pin and the pin 4 is the GND pin.

When the level $V_4$ of the pin 4 is greater than the sum of the level $V_3$ of the pin 3 and the predetermined threshold $V_g$ (i.e. $V_4>V_3+V_g$), the triode Ta is in an ON state, the triode Tb is in an OFF state, and the triode Tc is in an ON state. The VBAT supplies power to the switching module via the VCC and a high level signal is received by the Sel pin of the switching module, which indicates the pin 4 is the MIC pin and the pin 3 is the GND pin.

The predetermined threshold $V_g$ is greater than or equal to 0. In the embodiment, the threshold $V_g$ may be a breakover voltage of the triode Ta, such as 0.3V or 0.7V.

The "high level signal" refers to a signal whose level is higher than the level of the above "low level signal". Generally, the "low level signal" is a signal whose voltage is lower than 0.7V, while the "high level signal" is a signal whose voltage is higher than seventy percent of a voltage of the power, the definitions of which may also be applied to descriptions hereinafter.

The switching module connects the B1H pin or the B0L pin to the pin A according to a signal received by the Sel pin, such that the pin 3 or the pin 4 of the audio interface is connected to the ground.

When a low level signal is received by the Sel pin of the switching module, the switching module connects the B0L pin to the pin A, i.e. the B0L pin/the pin 4 of the audio interface is connected to the ground.

When a high level signal is received by the Sel pin of the switching module, the switching module connects the B1H pin to the pin A, i.e. the B1H pin/the pin 3 of the audio interface is connected to the ground.

According to a basic principle of the present invention, various variations may be made to the embodiment described above, for example:

1) changing the connection between the pin 3 of the audio interface and other components, and the connection between the pin 4 of the audio interface and other components;
2) connecting the signal input pin (Sel) of the switching module between the resistor R2*a* and the collector (C) of the triode Ta.

Embodiment 2

Figure 2:
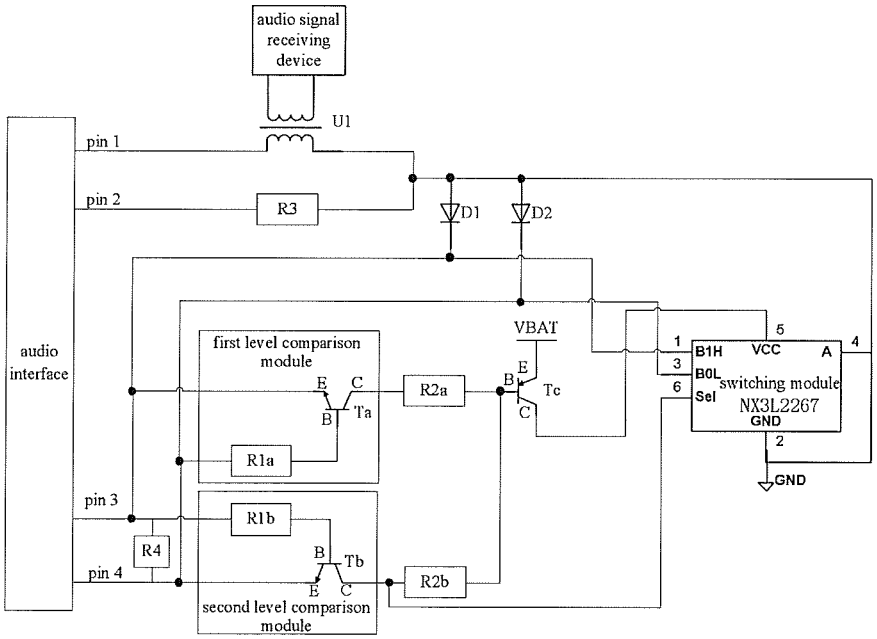
FIG. 2 is a schematic view of an audio interface self-adaption device according to a second embodiment of the present disclosure.

FIG. 2 is a schematic view of an audio interface self-adaption device according to a second embodiment of the present disclosure. As shown in FIG. 2, the differences between the present embodiment and the Embodiment 1 are as follows.

(1) The pin 1 is connected to the pin 3 of the audio interface via a device having unidirectional conductivity (may be called a unidirectional conductive component, such as a diode, a triode, a MOS, and so on), the pin 1 is connected to the pin 4 of the audio interface via a device having unidirectional conductivity (may be called a unidirectional conductive component, such as a diode, a triode, a MOS, and so on), the pin 2 of the audio interface is connected to the pin 3 of the audio interface via a device having unidirectional conductivity (may be called a unidirectional conductive component such as a diode, a triode, a MOS, and so on), and the pin 2 of the audio interface is connected to the pin 4 of the audio interface via a device having unidirectional conductivity (may be called a unidirectional conductive component such as a diode, a triode, a MOS, and so on).

For example, as shown in FIG. 2, the pin 1 is connected to the pin 3 of the audio interface via a first signal processing module (such as a transformer U1) and a diode DE and the pin 2 of the audio interface is connected to the pin 3 of the audio interface via a second signal processing module (such as a resistor R3) and the diode D1. The pin 1 is connected to the pin 4 of the audio interface via the first signal processing module (such as the transformer U1) and a diode D2, and the pin 2 is connected to the pin 4 of the audio interface via the second signal processing module (such as the resistor R3) and the diode D2.

(2) The pin 3 and the pin 4 of the audio interface are connected via a resistor R4.

A resistance of the resistor R4 is greater than 1KΩ, and the resistance of the resistor R4 in the embodiment may be from 1KΩ to 20KΩ.

In the embodiment with the above additional technical features, the audio interface self-adaption device can be connected to an audio signal sending device with any type of audio interface, and pass a detection conducted by the audio signal sending device successfully.

Embodiment 3

Figure 3:
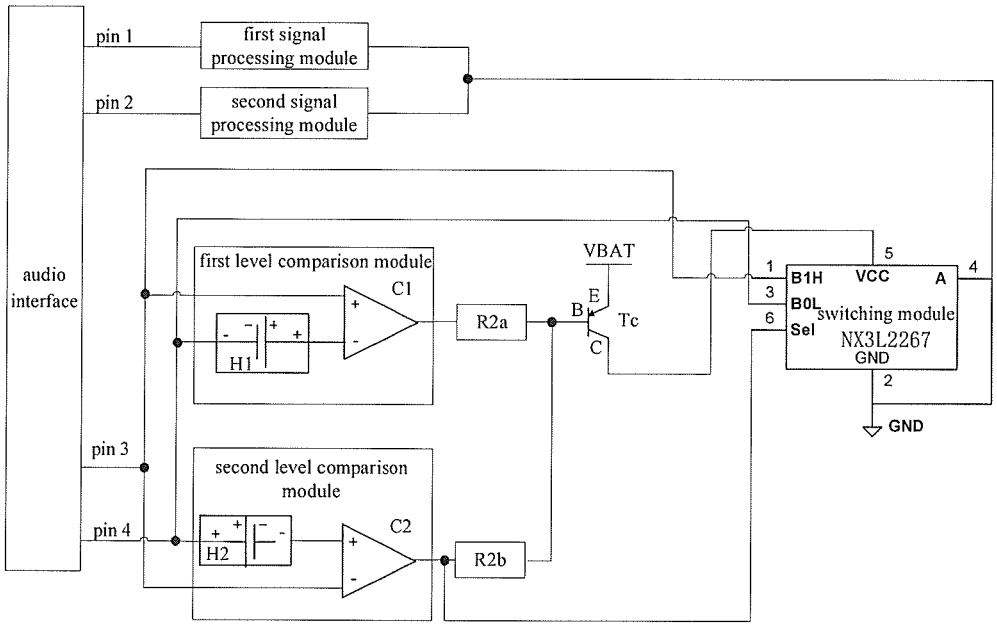
FIG. 3 is a schematic view of an audio interface self-adaption device according to a third embodiment of the present disclosure.

FIG. 3 is a schematic view of an audio interface self-adaption device according to a third embodiment of the present disclosure. As shown in FIG. 3, the audio interface self-adaption device of the embodiment comprises: an audio interface, a first level comparison module, a second level comparison module, a triode Tc, a power output terminal VBAT, a switching module, a resistor R2*a*, a resistor R2*b*, and so on.

The first level comparison module comprises a first reference voltage module H1 and a comparator C1.

The pin 3 is connected to a positive electrode of the comparator C1. The pin 4 is connected to a negative electrode of the comparator C1 via the first reference voltage module H1, i.e. the pin 4 is connected to a negative electrode of the first reference voltage module H1, and a positive electrode of the first reference voltage module H1 is connected to the negative electrode of the comparator C1.

In the embodiment, the first reference voltage module H1 may be a power, and the power has a positive electrode being the positive electrode of the first reference voltage module H1 and a negative electrode being the negative electrode of the first reference voltage module H1. The voltage provided by the first reference voltage module H1 is a predetermined threshold $V_g$.

In other embodiments of the present disclosure, the first reference voltage module H1 may be a component which can supply a reference voltage (the threshold voltage) such as a diode connected to the power.

An output pin of the comparator C1 is connected to the base (B) of the triode Tc via the resistor R2*a*.

The second level comparison module comprises a second reference voltage module H2 and a comparator C2.

The pin 3 is connected to a negative electrode of the comparator C2. The pin 4 is connected to a positive electrode of the comparator C2 via the second reference voltage module H2, i.e. the pin 4 is connected to a positive electrode of the second reference voltage module H2, and a negative electrode of the second reference voltage module H2 is connected to the positive electrode of the comparator C2.

In the embodiment, the second reference voltage module H2 may be a power, and the power has a positive electrode being the positive electrode of the second reference voltage module H2 and a negative electrode being the negative electrode of the second reference voltage module H2. The voltage provided by the second reference voltage module H2 is the predetermined threshold $V_g$.

In other embodiments of the present disclosure, the second reference voltage module H2 may be a component which can supply a reference voltage (the threshold voltage) such as a diode connected to the power.

An output pin of the comparator C2 is connected to a signal input pin (Sel) of the switching module, and the output pin of the comparator C2 is connected to the base (B) of the triode Tc via the resistor R2*b*.

Each of the resistor R2*a* and the resistor R2*b* has a resistance from 1KΩ to 1 MΩ.

A B1H pin of the switching module is connected to the pin 3 of the audio interface, a B0L pin of the switching module is connected to the pin 4 of the audio interface, a ground pin (GND pin) of the switching module is connected to the ground (GND pin), and a pin A of the switching module is connected to the ground, and the pin A is connected to the pin 1 and the pin 2 of the audio interface.

Furthermore, the pin 1 of the audio interface may be connected to a ground wire via a first signal processing module, and the pin 2 of the audio interface may be connected to the ground wire via a second signal processing module.

Each of the first signal processing module and the second signal processing module may comprise at least one selected from a group consisting of: a resistor, a louder speaker, a transformer, and a signal processing module comprising a resistor and a comparator connected in parallel.

In the embodiment, when a level $V_3$ of the pin 3 is greater than a sum of the level $V_4$ of the pin 4 and a predetermined threshold $V_g$ (i.e. $V_3>V_4+V_g$), a high level signal is output by the comparator C1 of the first level comparison module, a low level signal is output by the comparator C2 of the second level comparison module, the triode Tc is in an ON state, the VBAT supplies power to the switching module via the VCC, and a low level signal is received by the Sel pin of the switching module, which indicates the pin 3 is the MIC pin and the pin 4 is the GND pin.

When the level $V_4$ of the pin 4 is greater than the sum of the level $V_3$ of the pin 3 and the predetermined threshold $V_g$ (i.e. $V_4>V_3+V_g$), a low level signal is output by the comparator C1 of the first level comparison module, a high level signal is output by the comparator C2 of the second level comparison module, the triode Tc is in an ON state, the VBAT supplies power to the switching module via the VCC, and a high level signal is received by the Sel pin of the switching module, which indicates the pin 4 is the MIC pin and the pin 3 is the GND pin.

The switching module connects the B1H pin or the B0L pin to the pin A according to the signal received by the Sel pin, such that the pin 3 or the pin 4 of the audio interface is connected to the ground.

When a low level signal is received by the Sel pin of the switching module, the switching module connects the B0L pin to the pin A, i.e. the B0L pin/the pin 4 of the audio interface is connected to the ground.

When a high level signal is received by the Sel pin of the switching module, the switching module connects the B1H pin to the pin A, i.e. the B1H pin/the pin 3 of the audio interface is connected to the ground.

According to the basic principle of the present invention, various variations may be made to the embodiment described above, for example:

1) changing the connection between the pin 3 of the audio interface and other components and the connection between the pin 4 of the audio interface and other components;

2) connecting the signal input pin (Sel) of the switching module between the resistor R2*a* and the output pin of comparator C1.

Embodiment 4

Figure 4:
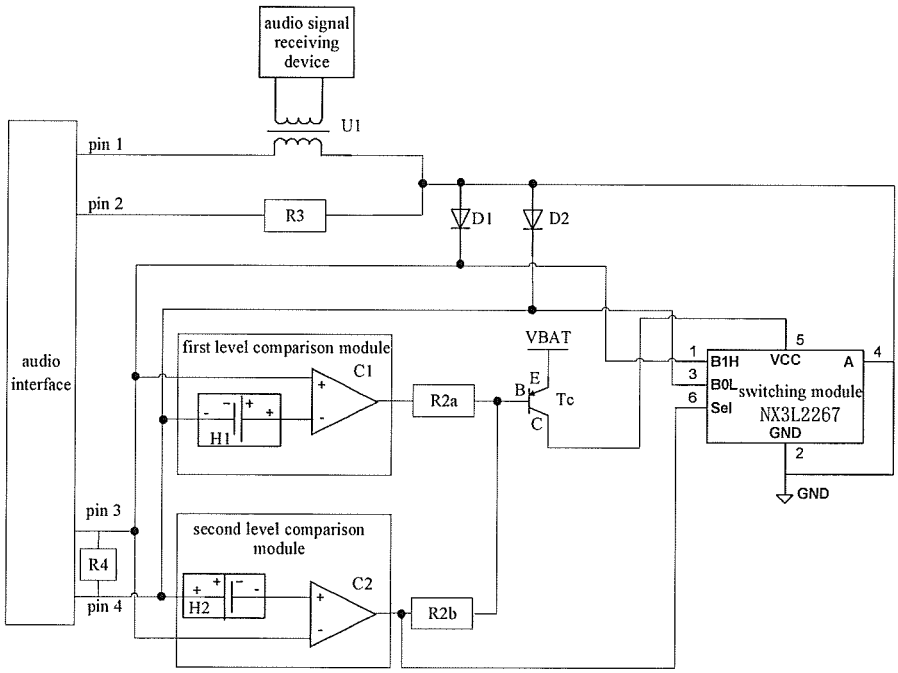
FIG. 4 is a schematic view of an audio interface self-adaption device according to a fourth embodiment of the present disclosure.

FIG. 4 is a schematic view of an audio interface self-adaption device according to a fourth embodiment of the present disclosure. As shown in FIG. 4, the differences between the present embodiment and the Embodiment 3 are as follows.

(1) The pin 1 of the audio interface is connected to the pin 3 of the audio interface via a device having unidirectional conductivity (referred as a unidirectional conductive component hereinafter, such as a diode, a triode, a MOS, and so on), the pin 1 of the audio interface is connected to the pin 4 of the audio interface via a device having unidirectional conductivity (referred as a unidirectional conductive component hereinafter, such as a diode, a triode, a MOS, and so on), the pin 2 of the audio interface is connected to the pin 3 of the audio interface via a device having unidirectional conductivity (referred as a unidirectional conductive component hereinafter, such as a diode, a triode, a MOS, and so on), and the pin 2 of the audio interface is connected to the pin 4 of the audio interface via a device having unidirectional conductivity (referred as a unidirectional conductive component hereinafter, such as a diode, a triode, a MOS, and so on).

For example, as shown in FIG. 4, the pin 1 of the audio interface is connected to the pin 3 of the audio interface via a diode D1, the pin 2 of the audio interface is connected to the pin 3 of the audio interface via the diode D1, the pin 1 of the audio interface is connected to the pin 4 of the audio interface via a diode D2, and the pin 2 of the audio interface is connected to the pin 4 of the audio interface via the diode D2.

(2) The pin 3 and the pin 4 of the audio interface are connected via a resistor R4.

The resistance of the resistor R4 is greater than 1KΩ, and the resistance of the resistor R4 of the embodiment may be from 1KΩ to 20KΩ.

In the embodiment with the above additional technical features, the audio interface self-adaption device can be connected to an audio signal sending device with any type of audio interface, and pass a detection conducted by the audio signal sending device successfully.

Embodiment 5

Figure 5:
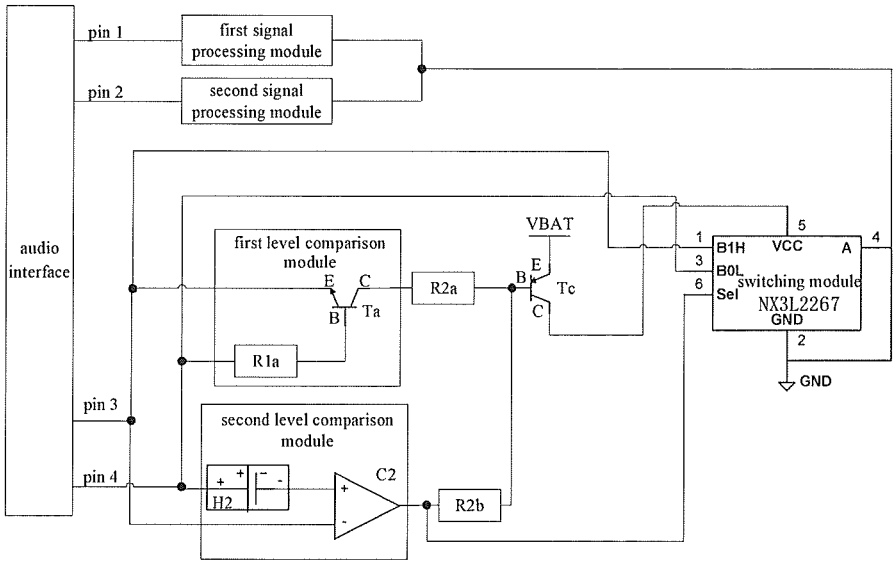
FIG. 5 is a schematic view of an audio interface self-adaption device according to a fifth embodiment of the present disclosure.

FIG. 5 is a schematic view of an audio interface self-adaption device according to a fifth embodiment of the present disclosure. As shown in FIG. 5, the audio interface self-adaption device of the embodiment comprises: an audio interface, a first level comparison module, a second level comparison module, a PNP triode Tc, a power output terminal VBAT, a switching module, a resistor R2*a*, a resistor R2*b*, and so on.

The first level comparison module comprises a NPN triode Ta.

A base (B) of the triode Ta is connected to the pin 4, an emitter (E) of the triode Ta is connected to the pin 3, and a collector (C) of the triode Ta is connected to a base (B) of the triode Tc via the resistor R2*a*.

Furthermore, the base (B) of the triode Ta may be connected to the pin 4 via a resistor R1*a*.

The second level comparison module comprises a second reference voltage module H2 and a comparator C2.

The pin 3 is connected to a negative electrode of the comparator C2. The pin 4 is connected to a positive electrode of the comparator C2 via the second reference voltage module H2, i.e. the pin 4 is connected to a positive electrode of the second reference voltage module H2, and a negative electrode of the second reference voltage module H2 is connected to the positive electrode of the comparator C2.

In the embodiment, the second reference voltage module H2 may be a power, and the power has a positive electrode being the positive electrode of the second reference voltage module H2 and a negative electrode being the negative electrode of the second reference voltage module H2. The voltage provided by the second reference voltage module H2 is a predetermined threshold $V_g$.

In other embodiments of the present disclosure, the second reference voltage module H2 may be a component which can supply a reference voltage (threshold voltage), such as a diode connected to a power.

An output pin of the comparator C2 is connected to a signal input pin (Sel) of the switching module, and the output pin of the comparator C2 is connected to the base (B) of the triode Tc via the resistor R2*b*.

Each of the resistor R2*a* and the resistor R2*b* has a resistance from 1KΩ to 1 MΩ.

A B1H pin of the switching module is connected to the pin 3 of the audio interface, a B0L pin of the switching module is connected to the pin 4 of the audio interface, a ground pin (GND pin) of the switching module is connected to the ground, and a pin A of the switching module is connected to the ground, and the pin A of the switching module is connected to the pin 1 and the pin 2 of the audio interface.

Furthermore, the pin 1 of the audio interface may be connected to a ground wire via a first signal processing module, and the pin 2 of the audio interface may be connected to the ground wire via a second signal processing module.

Each of the first signal processing module and the second signal processing module may comprise at least one selected from a group consisting of: a resistor, a louder speaker, a transformer, and a signal processing module comprising a resistor and a comparator connected in parallel.

In the embodiment, when a level $V_3$ of the pin 3 is greater than a sum of the level $V_4$ of the pin 4 and a threshold $V_g$ (i.e. $V_3>V_4+V_g$), the triode Ta is in an OFF state, a low level signal is output by the comparator C2 of the second level comparison module, the triode Tc is in an ON state, the VBAT supplies power to the switching module via the VCC, and a low level signal is received by the Sel pin of the switching module, which indicates the pin 3 is the MIC pin and the pin 4 is the GND pin.

When the level $V_4$ of the pin 4 is greater than the sum of the level $V_3$ of the pin 3 and the threshold $V_g$ (i.e. $V_4>V_3+V_g$), the triodes Ta is in an ON state, a high level signal is output by the comparator C2 of the second level comparison module, the triodes Tc is in an ON state, the VBAT supplies power to the switching module via the VCC, and a high level signal is received by the Sel pin of the switching module, which indicates the pin 4 is the MIC pin and the pin 3 is the GND pin.

The threshold $V_g$ is greater than or equal to 0. In the embodiment, the threshold $V_g$ may be a breakover voltage of the triode Ta, such as 0.3V or 0.7V.

The switching module connects the B1H pin or the B0L pin to the pin A according to the signal received by the Sel pin, such that the pin 3 or the pin 4 of the audio interface is connected to the ground.

When a low level signal is received by the Sel pin of the switching module, the switching module connects the B0L pin to the pin A, i.e. the B0L pin/the pin 4 of the audio interface is connected to the ground.

When a high level signal is received by the Sel pin of the switching module, the switching module connects the B1H pin to the pin A, i.e. the B1H pin/the pin 3 of the audio interface is connected to the ground.

According to the basic principle of the present invention, various variations may be made to the embodiment described above, for example:

1) changing the connection between the pin 3 of the audio interface and other components and the connection between the pin 4 of the audio interface and other components.
2) connecting the signal input pin (Sel) of the switching module is between the resistor R2*a* and the collector (C) of the triode Ta.

Embodiment 6

Figure 6:
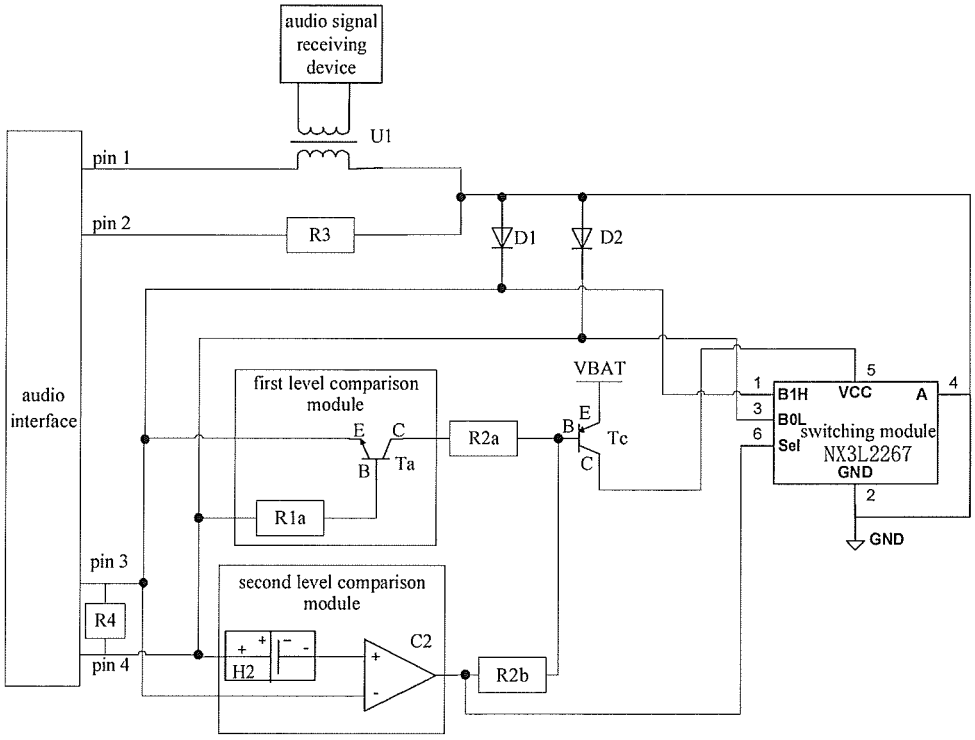
FIG. 6 is a schematic view of an audio interface self-adaption device according to a sixth embodiment of the present disclosure.

FIG. 6 is a schematic view of an audio interface self-adaption device according to a sixth embodiment of the present disclosure. As shown in FIG. 6, the differences between the sixth embodiment and the fifth embodiment are as follows.

(1) The pin 1 of the audio interface is connected to the pin 3 of the audio interface via a device having unidirectional conductivity (referred as a unidirectional conductive component hereinafter, such as a diode, a triode, a MOS, and so on), the pin 1 of the audio interface is connected to the pin 4 of the audio interface via a device having unidirectional conductivity (referred as a unidirectional conductive component hereinafter, such as a diode, a triode, a MOS, and so on), the pin 2 of the audio interface is connected to the pin 3 of the audio interface via a device having unidirectional conductivity (referred as a unidirectional conductive component hereinafter, such as a diode, a triode, a MOS, and so on), and the pin 2 of the audio interface is connected to the pin 4 of the audio interface via a device having unidirectional conductivity (referred as a unidirectional conductive component hereinafter, such as a diode, a triode, a MOS, and so on).

For example, as shown in FIG. 6, the pin 1 of the audio interface is connected to the pin 3 of the audio interface via a diode D1, the pin 2 of the audio interface is connected to the pin 3 of the audio interface via the diode D1, the pin 1 of the audio interface is connected to the pin 4 of the audio interface via a diode D2, and the pin 2 of the audio interface is connected to the pin 4 of the audio interface via the diode D2.

(2) The pin 3 and the pin 4 of the audio interface are connected via a resistor R4.

The resistance of the resistor R4 is greater than 1KΩ, and the resistance of the resistor R4 in the embodiment may be from 1KΩ to 20KΩ.

In the embodiment with the above additional technical features, the audio interface self-adaption device can be connected to an audio signal sending device with any type of audio interface, and pass a detection conducted by the audio signal sending device successfully.

Embodiment 7

Figure 7:
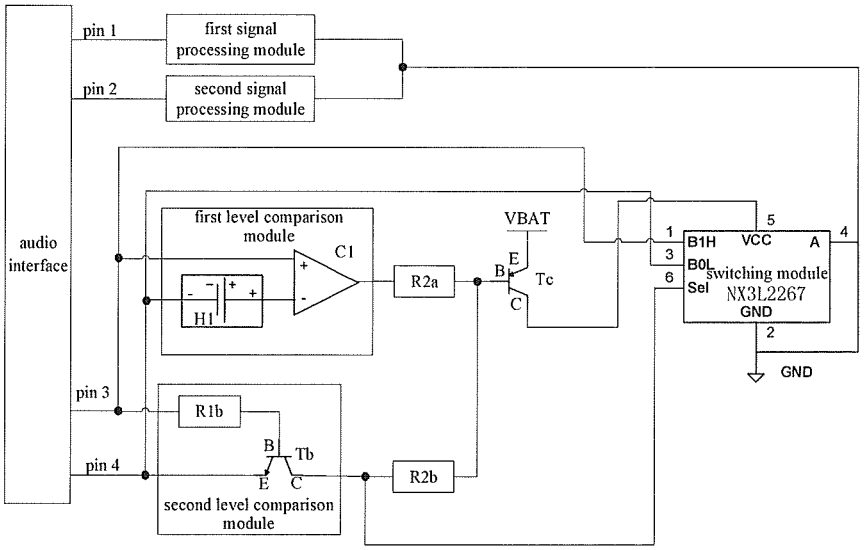
FIG. 7 is a schematic view of an audio interface self-adaption device according to a seventh embodiment of the present disclosure.

FIG. 7 is a schematic view of an audio interface self-adaption device according to a seventh embodiment of the present disclosure. As shown in FIG. 7, the audio interface self-adaption device of the embodiment comprises: an audio interface, a first level comparison module, a second level comparison module, a PNP triode Tc, a power output terminal VBAT, a switching module, a resistor R2*a*, a resistor R2*b*, and so on.

The first level comparison module comprises a first reference voltage module H1 and a comparator C1.

The pin 3 is connected to a positive electrode of the comparator C1. The pin 4 is connected to a negative electrode of the comparator C1 via the first reference voltage module H1, i.e. the pin 4 is connected to a negative electrode of the first reference voltage module H1, and a positive electrode of the first reference voltage module H1 is connected to the negative electrode of the comparator C1.

In the embodiment, the first reference voltage module H1 may be a power, and the power has a positive electrode being the positive electrode of the first reference voltage module H1 and a negative electrode being the negative electrode of the first reference voltage module H1. The voltage provided by the first reference voltage module H1 is a threshold $V_g$.

In other embodiments of the present disclosure, the first reference voltage module H1 may be a component which can supply a reference voltage (threshold voltage) such as a diode connected to the power.

An output pin of the comparator C1 is connected to a base (B) of the triode Tc via the resistor R2*a*.

The second level comparison module comprises a NPN triode Tb.

A base (B) of the triode Tb is connected to the pin 3, an emitter (E) of the triode Tb is connected to the pin 4, and a collector (C) of the triode Tb is connected to a signal input pin (Sel) of the switching module, and the collector (C) of the triode Tb is connected to the base (B) of the triode Tc via the resistor R2*b*.

Moreover, the base (B) of the triode Tb and the pin 3 may be connected via a resistor R1*b*.

If an ordinary battery is used as the power, the voltage output by the power is generally from 2.7V to 4.2V.

A B1H pin of the switching module is connected to the pin 3 of the audio interface, a B0L pin of the switching module is connected to the pin 4 of the audio interface, a ground pin (GND pin) of the switching module is connected to the ground, a pin A of the switching module is connected to the ground, and the pin A of the switching module is connected to the pin 1 and the pin 2 of the audio interface.

Furthermore, the pin 1 of the audio interface may be connected to a ground wire via a first signal processing module, and the pin 2 of the audio interface may be connected to the ground wire via a second signal processing module.

Each of the first signal processing module and the second signal processing module may comprise at least one selected from a group consisting of: a resistor, a louder speaker, a transformer, and a signal processing module comprising a resistor and a comparator connected in parallel.

In the embodiment, when the level $V_3$ of the pin 3 is greater than a sum of the level $V_4$ of the pin 4 and a predetermined threshold $V_g$ (i.e. $V_3>V_4+V_g$), a high level signal is output by the comparator C1 of the first level comparison module, the triode Tb is in an ON state, the triode Tc is in an ON state, the VBAT supplies power to the switching module via the VCC, and a low level signal is received by the Sel pin of the switching module, which indicates the pin 3 is the MIC pin and the pin 4 is the GND pin.

When the level $V_4$ of the pin 4 is greater than the sum of the level $V_3$ of the pin 3 and the predetermined threshold $V_g$ (i.e. $V_4>V_3+V_g$), a low level signal is output by the comparator C1 of the first level comparison module, the triode Tb is in an OFF state, the triode Tc is in an ON state, the VBAT supplies power to the switching module via the VCC, and a high level signal is received by the Sel pin of the switching module, which indicates the pin 4 is the MIC pin and the pin 3 is the GND pin.

The above predetermined threshold $V_g$ is greater than or equal to 0. In the embodiment, the threshold $V_g$ may be a breakover voltage of the triode Ta, such as 0.3V or 0.7V.

The switching module connects the B1H pin or the B0L pin to the pin A according to a signal received by the Sel pin, such that the pin 3 or the pin 4 of the audio interface is connected to the ground.

When a low level signal is received by the Sel pin of the switching module, the switching module connects the B0L pin to the pin A, i.e. the B0L pin/the pin 4 of the audio interface is connected to the ground.

When a high level signal is received by the Sel pin of the switching module, the switching module connects the B1H pin to the pin A, i.e. the B1H pin/the pin 3 of the audio interface is connected to the ground.

According to the basic principle of the present invention, various variations may be made to the embodiment described above, for example:

1) changing the connection between the pin 3 of the audio interface and other components and the connection between the pin 4 of the audio interface and other components.
2) connecting the signal input pin (Sel) of the switching module between the resistor R2*a* and the output pin of the comparator C1.

Embodiment 8

Figure 8:
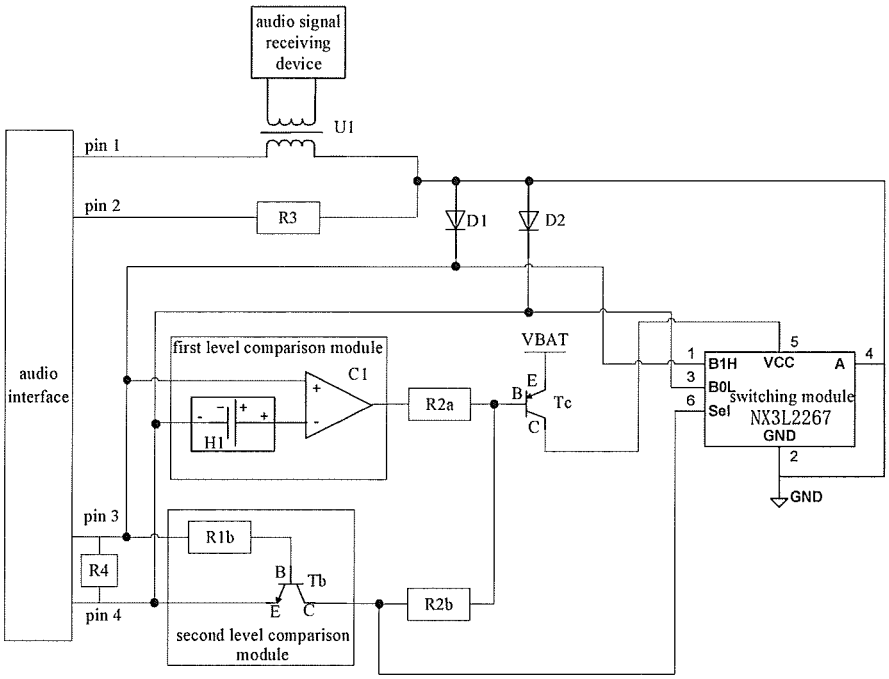
FIG. 8 is a schematic view of an audio interface self-adaption device according to an eighth embodiment of the present disclosure.

FIG. 8 is a schematic view of an audio interface self-adaption device according to an eighth embodiment of the present disclosure. As shown in FIG. 8, the differences between the present embodiment and Embodiment 7 are as follows.

(1) The pin 1 of the audio interface is connected to the pin 3 of the audio interface via a unidirectional conductive component (such as a diode, a triode, a MOS, and so on), the pin 1 of the audio interface is connected to the pin 4 of the audio interface via a unidirectional conductive component (such as a diode, a triode, a MOS, and so on), the pin 2 of the audio interface is connected to the pin 3 of the audio interface via a unidirectional conductive component (such as a diode, a triode, a MOS, and so on), and the pin 2 of the audio interface is connected to the pin 4 of the audio interface via a unidirectional conductive component (such as a diode, a triode, a MOS, and so on).

For example, as shown in FIG. 8, the pin 1 of the audio interface is connected to the pin 3 of the audio interface via a diode D1, the pin 2 of the audio interface is connected to the pin 3 of the audio interface via the diode D1, the pin 1 of the audio interface is connected to the pin 4 of the audio interface via a diode D2, and the pin 2 of the audio interface is connected to the pin 4 of the audio interface via the diode D2.

(2) The pin 3 and the pin 4 of the audio interface are connected via a resistor R4.

The resistance of the resistor R4 is greater than 1KΩ, and the resistance of the resistor R4 of the embodiment may be from 1KΩ to 20KΩ.

In the embodiment with the above additional technical features, the audio interface self-adaption device can be connected to an audio signal sending device with any type of audio interface, and pass a detection conducted by the audio signal sending device successfully.

Embodiment 9

Figure 9:
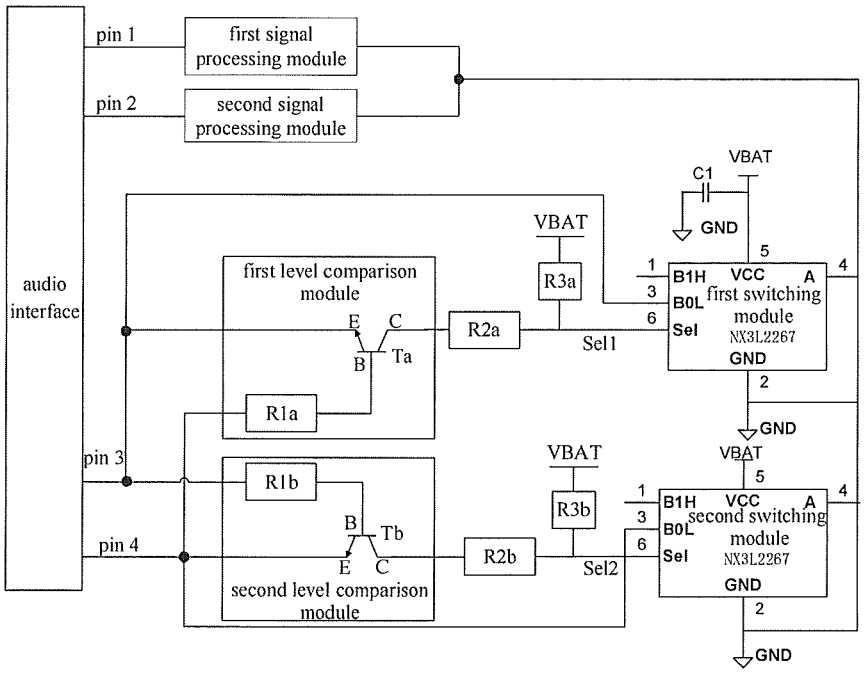
FIG. 9 is a schematic view of an audio interface self-adaption device according to a ninth embodiment of the present disclosure.

FIG. 9 is a schematic view of an audio interface self-adaption device according to a ninth embodiment of the present disclosure. As shown in FIG. 9, the audio interface self-adaption device of the embodiment comprises: an audio interface, a first level comparison module, a second level comparison module, a power output terminal VBAT, a first switching module, a second switching module, and a resistor R2*a*, a resistor R2*b*, a resistor R3*a*, a resistor R3*b*, and so on.

The first level comparison module comprises a triode Ta, and the second level comparison module comprises a triode Tb.

The triode Ta is a NPN triode, and the triode Ta is a NPN triode.

A base (B) of the triode Ta is connected to the pin 4, an emitter (E) of the triode Ta is connected to the pin 3, a collector (C) of the triode Ta is connected to the power output terminal VBAT via the resistor R2*a* and the resistor R3*a*, and the collector (C) of the triode Ta is connected to a signal input pin (Sel1) of the first switching module via the resistor R2*a*.

Furthermore, the base (B) of the triode Ta may be connected to the pin 4 via a resistor R1*a*.

A base (B) of the triode Tb is connected to the pin 3, an emitter (E) of the triode Tb is connected to the pin 4, a collector (C) of the triode Tb is connected to the power output terminal VBAT via the resistor R2*b* and the resistor R3*b*, and the collector (C) of the triode Tb is connected to a signal input pin (Sel2) of the second switching module via the resistor R2*b*.

Moreover, the base (B) of the triode Tb and the pin 3 may be connected via a resistor R1*b*.

Each of the resistor R1*a*, the resistor R2*a*, the resistor R1*b*, the resistor R2*b*, the resistor R3*a*, and the resistor R3*b* has a resistance from 1KΩ to 1 MΩ.

If an ordinary battery is used as the power, the voltage output by the power is generally from 2.7 to 4.2V.

A B0L pin of the first switching module is connected to the pin 3 of the audio interface, a B0L pin of the second switching module is connected to the pin 4 of the audio interface, a ground pin (GND pin) of the first switching module is connected to the ground, a ground pin (GND pin) of the second switching module is connected to the ground, a pin A (may be called an output pin) of the first switching module is connected to the ground, and the pin A of the first switching module is connected to the pin 1 and the pin 2 of the audio interface, a pin A (may be called an output pin) of the second switching module is connected to the ground, and the pin A of the second switching module is connected to the pin 1 and the pin 2 of the audio interface.

Furthermore, the pin 1 of the audio interface may be connected to a ground wire via a first signal processing module, and the pin 2 of the audio interface may be connected to the ground wire via a second signal processing module.

Each of the first signal processing module and the second signal processing module may comprise a resistor, a louder speaker, a transformer, and a signal processing module comprising a resistor and a comparator connected in parallel.

In the embodiment, when a level $V_3$ of the pin 3 is greater than a sum of a level $V_4$ of the pin 4 and a predetermined threshold $V_g$ (i.e. $V_3>V_4+V_g$), the triode Ta is in an OFF state, the triode Tb is in an ON state, a low level signal is received by the Sel2 pin of the second switching module, which indicates the pin 3 is the MIC pin and the pin 4 is the GND pin.

When the level $V_4$ of the pin 4 is greater than the sum of the level $V_3$ of the pin 3 and a predetermined threshold $V_g$ (i.e. $V_4>V_3+V_g$), the triode Ta is in an ON state, the triode Tb is in an OFF state, a low level signal is received by the Sel1 pin of the first switching module, which indicates the pin 4 is the MIC pin and the pin 3 is the GND pin.

The predetermined threshold $V_g$ is greater than or equal to 0. In the embodiment, the threshold $V_g$ may be a breakover voltage of the triode Ta, such as 0.3V or 0.7V.

The above "high level signal" is a signal whose level is higher than a level of the above "low level signal". Generally, the "low level signal" is a signal whose voltage is lower than 0.7V, while the "high level signal" is a signal whose voltage is higher than seventy percent of the supply voltage, the definitions of which may be applied to descriptions hereinafter.

The second switching module connects the B0L pin to the pin A according to a low level signal received by the Sel2 pin, such that the pin 4 of the audio interface is connected to the ground.

When a low level signal is received by the Sel2 pin of the second switching module, the second switching module connects the B0L pin to the pin A, i.e. the B0L pin/the pin 4 of the audio interface is connected to the ground.

The first switching module connects the B0L pin to the pin A according to a low level signal received by the Sel1 pin, such that the pin 3 of the audio interface is connected to the ground.

When a low level signal is received by the Sel1 pin of the first switching module, the first switching module connects the B0L pin to the pin A, i.e. the B0L pin/the pin 3 of the audio interface is connected to the ground.

According to the basic principle of the present invention, various variations may be made to the embodiment described above, for example:

1) changing the connection between the pin 3 of the audio interface and other components and the connection between the pin 4 of the audio interface and other components;
2) connecting the pin 4 of the audio interface to the B1H instead of the B0L of the first switching module, and connecting the pin 3 of the audio interface to the B1H instead of the B0L of the second switching module.

Embodiment 10

Figure 10:
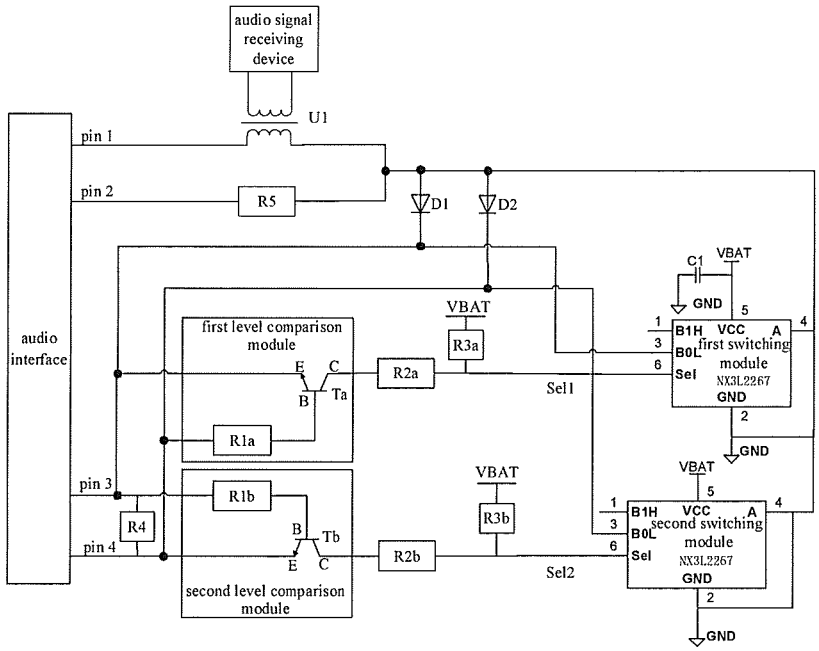
FIG. 10 is a schematic view of an audio interface self-adaption device according to a tenth embodiment of the present disclosure.

FIG. 10 is a schematic view of an audio interface self-adaption device according to a tenth embodiment of the present disclosure. As shown in FIG. 10, the differences between the present embodiment and Embodiment 9 are as follows.

(1) The pin 1 of the audio interface is connected to the pin 3 of the audio interface via a device having unidirectional conductivity (referred as a unidirectional conductive component hereinafter, such as a diode, a triode, a MOS, and so on), the pin 1 of the audio interface is connected to the pin 4 of the audio interface via a device having unidirectional conductivity (referred as a unidirectional conductive component hereinafter, such as a diode, a triode, a MOS, and so on), the pin 2 of the audio interface is connected to the pin 3 of the audio interface via a device having unidirectional conductivity (referred as a unidirectional conductive component hereinafter, such as a diode, a triode, a MOS, and so on), and the pin 2 of the audio interface is connected to the pin 4 of the audio interface via a device having unidirectional conductivity (referred as a unidirectional conductive component hereinafter, such as a diode, a triode, a MOS, and so on).

For example, as shown in FIG. 10, the pin 1 of the audio interface is connected to the pin 3 of the audio interface via a first signal processing module (such as a transformer U1) and a diode D1, the pin 2 of the audio interface is connected to the pin 3 of the audio interface via a second signal processing module (such as a resistor R5) and the diode D1, the pin 1 of the audio interface is connected to the pin 4 of the audio interface via a first signal processing module (such as the transformer U1) and a diode D2, and the pin 2 of the audio interface is connected to the pin 4 of the audio interface via a second signal processing module (such as the resistor R5) and the diode D2.

(2) The pin 3 and the pin 4 of the audio interface are connected via a resistor R4.

The resistance of the resistor R4 is greater than 1KΩ, and the resistance of the resistor R4 of the embodiment may be from 1KΩ to 20KΩ.

In the embodiment with the above additional technical features, the audio interface self-adaption device can be connected to an audio signal sending device with any type of audio interface, and pass a detection conducted by the audio signal sending device successfully.

Embodiment 11

Figure 11:
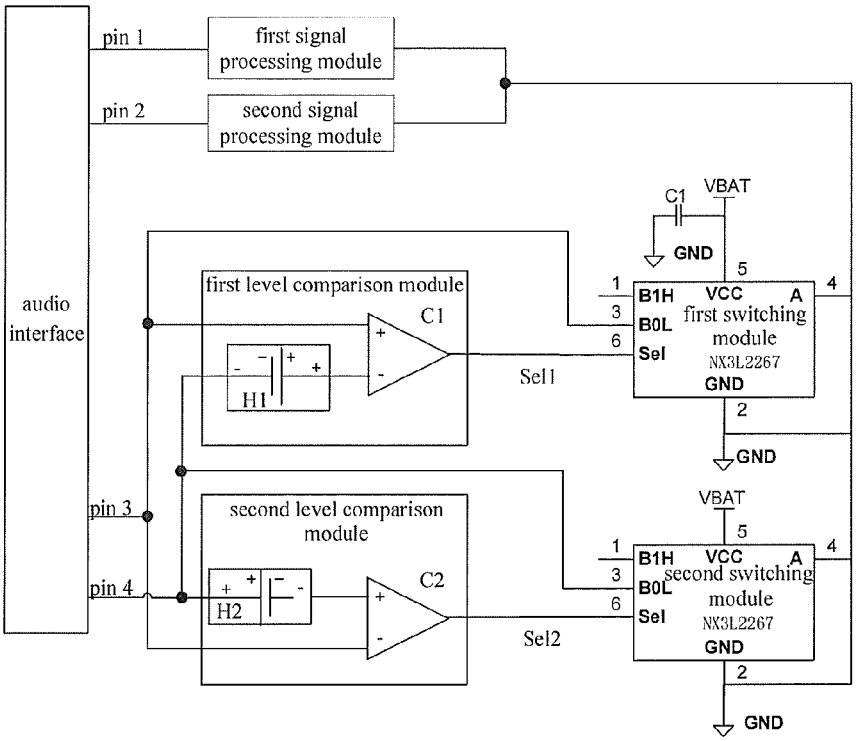
FIG. 11 is a schematic view of an audio interface self-adaption device according to an eleventh embodiment of the present disclosure.

FIG. 11 is a schematic view of an audio interface self-adaption device according to an eleventh embodiment of the present disclosure. As shown in FIG. 11, the audio interface self-adaption device of the embodiment comprises: an audio interface, a first level comparison module, a second level comparison module, a power output terminal VBAT, a first switching module, a second switching module, and so on.

The first level comparison module comprises a first reference voltage module H1 and a comparator C1.

The pin 3 is connected to a positive electrode of the comparator C1. The pin 4 is connected to a negative electrode of the comparator C1 via the first reference voltage module H1, i.e. the pin 4 is connected to a negative electrode of the first reference voltage module H1, and a positive electrode of the first reference voltage module H1 is connected to the negative electrode of the comparator C1.

In the embodiment, the first reference voltage module H1 may be a power, and the power has a positive electrode being the positive electrode of the first reference voltage module H1 and a negative electrode being the negative electrode of the first reference voltage module H1. The voltage provided by the first reference voltage module H1 is a threshold $V_g$.

In other embodiments of the present disclosure, the first reference voltage module H1 may be a component which can supply a reference voltage (threshold voltage) such as a diode connected to the power.

An output pin of the comparator C1 is connected to a signal input pin (Sel1) of the first switching module.

The second level comparison module comprises a second reference voltage module H2 and a comparator C2.

The pin 3 is connected to a negative electrode of the comparator C2. The pin 4 is connected to a positive electrode of the comparator C2 via the second reference voltage module H2, i.e. the pin 4 is connected to a positive electrode of the second reference voltage module H2, and a negative electrode of the second reference voltage module H2 is connected to the positive electrode of the comparator C2.

In the embodiment, the second reference voltage module H2 may be a power, and the power has a positive electrode being the positive electrode of the second reference voltage module H2 and a negative electrode being the negative electrode of the second reference voltage module H2. The voltage provided by the second reference voltage module H2 is the threshold $V_g$.

In other embodiments of the present disclosure, the second reference voltage module H2 may be a component which can supply a reference voltage (threshold voltage), such as a diode connected to a power.

An output pin of the comparator C2 is connected to a signal input pin (Sel2) of the second switching module.

A B0L pin of the first switching module is connected to the pin 3 of the audio interface, a B0L pin of the second switching module is connected to the pin 4 of the audio interface, a ground pin (GND pin) of the first switching module is connected to the ground, a ground pin (GND pin) of the second switching module is connected to the ground, a pin A of the first switching module is connected to the ground, the pin A of the first switching module is connected to the pin 1 and the pin 2 of the audio interface respectively, a pin A of the second switching module is connected to the ground, and the pin A of the second switching module is connected to the pin 1 and the pin 2 of the audio interface respectively.

Furthermore, the pin 1 of the audio interface may be connected to a ground wire via a first signal processing module, and the pin 2 of the audio interface may be connected to the ground wire via a second signal processing module.

Each of the first signal processing module and the second signal processing module may comprise at least one selected from a group consisting of: a resistor, a louder speaker, a transformer, and a signal processing module comprising a resistor and a comparator connected in parallel.

In the embodiment, when a level $V_3$ of the pin 3 is greater than a sum of a level $V_4$ of the pin 4 and a threshold $V_g$ (i.e. $V_3>V_4+V_g$), a high level signal is output by the comparator C1 of the first switching module, a low level signal is output by the comparator C2 of the second switching module, a low level signal is received by the Sel2 pin of the second switching module, which indicates the pin 3 is the MIC pin and the pin 4 is the GND pin.

When the level $V_4$ of the pin 4 is greater than the sum of the level $V_3$ of the pin 3 and the threshold $V_g$ (i.e. $V_4>V_3+V_g$), a low level signal is output by the comparator C1 of the first switching module, a high level signal is output by the comparator C2 of the second switching module, a low level signal is received by the Sel1 pin of the first switching module, which indicates the pin 4 is the MIC pin and the pin 3 is the GND pin.

The first switching module connects the B0L pin to the pin A according to the low level signal received by the Sel1 pin, such that the pin 3 of the audio interface is connected to the ground.

When a low level signal is received by the Sel1 pin of the first switching module, the first switching module connects the B0L pin to the pin A, i.e. the B0L pin/the pin 3 of the audio interface is connected to the ground.

The second switching module connects the B0L pin to the pin A according to the low level signal received by the Sel2 pin, such that the pin 4 of the audio interface is connected to the ground.

When a low level signal is received by the Sel2 pin of the second switching module, the second switching module connects the B0L pin to the pin A, i.e. the B0L pin/the pin 4 of the audio interface is connected to the ground.

According to the basic principle of the present invention, various variations may be made to the embodiment described above, for example:

1) changing the connection between the pin 3 of the audio interface and other components and the connection between the pin 4 of the audio interface and other components;
2) connecting the pin 3 of the audio interface to the B1H instead of B0L of the first switching module, and connecting the pin 4 of the audio interface to the B1H instead of B0L of the second switching module.

Embodiment 12

Figure 12:
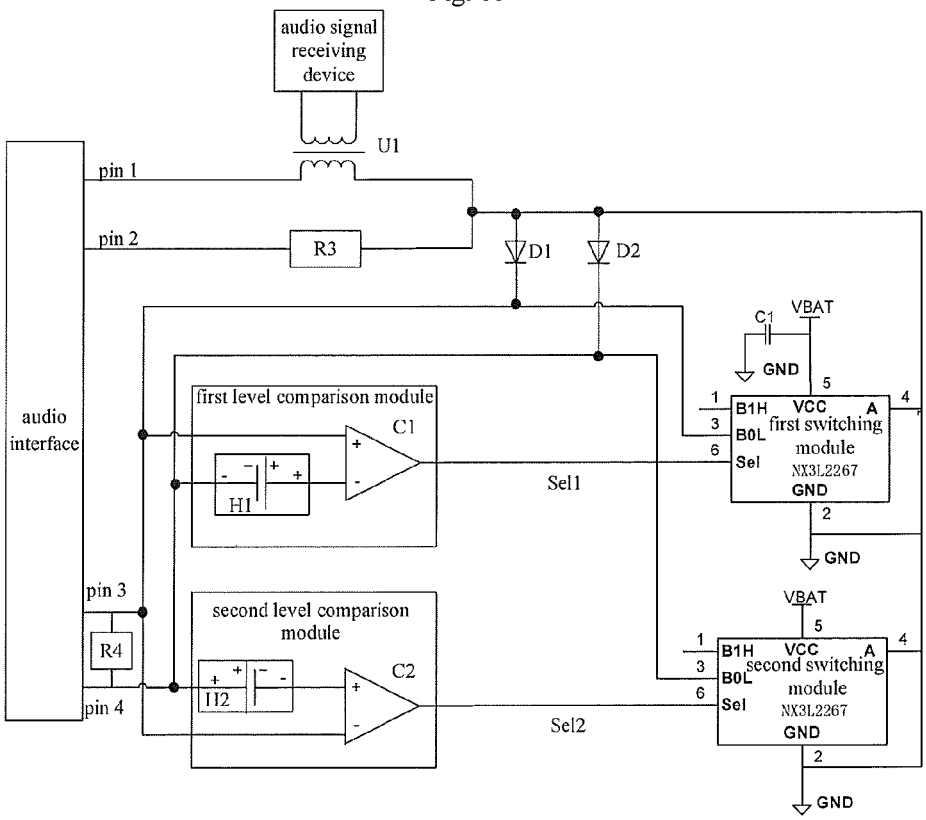
FIG. 12 is a schematic view of an audio interface self-adaption device according to a twelfth embodiment of the present disclosure.

FIG. 12 is a schematic view of an audio interface self-adaption device according to a twelfth embodiment of the present disclosure. As shown in FIG. 12, the differences between the present embodiment and Embodiment 11 are as follows.

(1) The pin 1 of the audio interface is connected to the pin 3 of the audio interface via a unidirectional conductive component (such as a diode, a triode, a MOS, and so on), the pin 1 of the audio interface is connected to the pin 4 of the audio interface via a unidirectional conductive component (such as a diode, a triode, a MOS, and so on), the pin 2 of the audio interface is connected to the pin 3 of the audio interface via a unidirectional conductive component (such as a diode, a triode, a MOS, and so on), and the pin 2 of the audio interface is connected to the pin 4 of the audio interface via a unidirectional conductive component (such as a diode, a triode, a MOS, and so on).

For example, as shown in FIG. 12, the pin 1 of the audio interface is connected to the pin 3 of the audio interface via a diode D1, the pin 2 of the audio interface is connected to the pin 3 of the audio interface via the diode D1, the pin 1 of the audio interface is connected to the pin 4 of the audio interface via a diode D2, and the pin 2 of the audio interface is connected to the pin 4 of the audio interface via the diode D2.

(2) The pin 3 and the pin 4 of the audio interface are connected via a resistor R4.

The resistance of the resistor R4 is greater than 1KΩ, and the resistance of the resistor R4 of the embodiment may be from 1KΩ to 20KΩ.

In the embodiment with the above additional technical features, the audio interface self-adaption device can be connected to an audio signal sending device with any type of audio interface, and pass a detection conducted by the audio signal sending device successfully.

Embodiment 13

Figure 13:
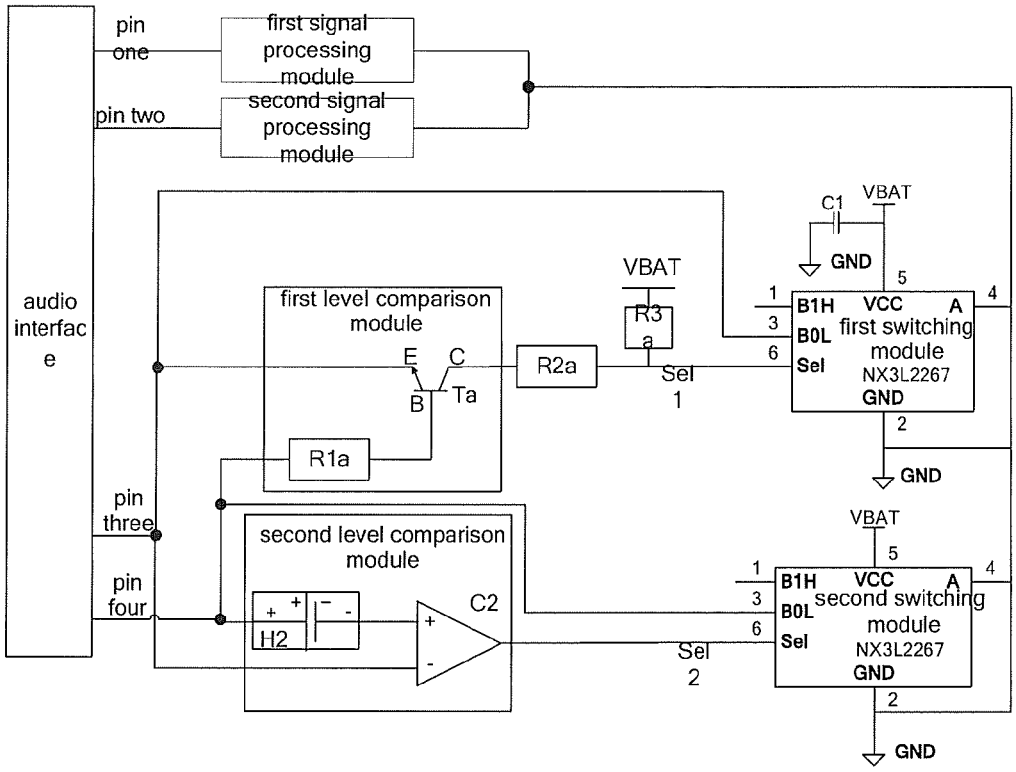
FIG. 13 is a schematic view of an audio interface self-adaption device according to a thirteenth embodiment of the present disclosure.

FIG. 13 is a schematic view of an audio interface self-adaption device according to a thirteenth embodiment of the present disclosure. As shown in FIG. 13, the audio interface self-adaption device of the embodiment comprises: an audio interface, a first level comparison module, a second level comparison module, a power output terminal VBAT, a first switching module, a second switching module, a resistor R2*a*, a resistor R3*a*, and so on.

The first level comparison module comprises a NPN triode Ta.

A base (B) of the triode Ta is connected to the pin 4, an emitter (E) of the triode Ta is connected to the pin 3, a collector (C) of the triode Ta is connected to the power output terminal VBAT via the resistor R2*a* and the resistor R3*a*, and the collector (C) of the triode Ta is connected to a signal input pin (Sel1) of the first switching module via the resistor R2*a*.

Furthermore, the base (B) of the triode Ta may be connected to the pin 4 via a resistor R1*a*.

The second level comparison module comprises a second reference voltage module H2 and a comparator C2.

The pin 3 is connected to a negative electrode of the comparator C2. The pin 4 is connected to a positive electrode of the comparator C2 via the second reference voltage module H2, i.e. the pin 4 is connected to a positive electrode of the second reference voltage module H2, and a negative electrode of the second reference voltage module H2 is connected to the positive electrode of the comparator C2.

In the embodiment, the second reference voltage module H2 may be a power, and the power has a positive electrode being the positive electrode of the second reference voltage module H2 and a negative electrode being the negative electrode of the second reference voltage module H2. The voltage provided by the second reference voltage module H2 is a threshold $V_g$.

In other embodiments of the present disclosure, the second reference voltage module H2 may be a component which can supply a reference voltage (threshold voltage), such as a diode connected to a power.

An output pin of the comparator C2 is connected to a signal input pin (Sel2) of the second switching module.

Each of the resistor R2*a* and the resistor R3*a* has a resistance from 1KΩ to 1 MΩ.

A B0L pin of the first switching module is connected to the pin 3 of the audio interface, a B0L pin of the second switching module is connected to the pin 4 of the audio interface, a ground pin (GND pin) of the first switching module is connected to the ground, a ground pin (GND pin) of the second switching module is connected to the ground, the ground pin (GND pin) of the first switching module is connected to the pin 1 and the pin 2 of the audio interface respectively, and the ground pin (GND pin) of the second switching module is connected to the pin 1 and the pin 2 of the audio interface respectively.

Furthermore, the pin 1 of the audio interface may be connected to a ground wire via a first signal processing module, and the pin 2 of the audio interface may be connected to the ground wire via a second signal processing module.

Each of the first signal processing module and the second signal processing module may comprise a resistor, a louder speaker, a transformer, and a signal processing module comprising resistor and comparator connected in parallel.

In the embodiment, when a level $V_3$ of the pin 3 is greater than a sum of a level $V_4$ of the pin 4 and a threshold $V_g$ (i.e. $V_3>V_4+V_g$), the triode Ta is in an OFF state, a low level signal is output by the comparator C2 of the second switching module, a low level signal is received by the Sel2 pin of the second switching module, which indicates the pin 3 is the MIC pin and the pin 4 is the GND pin.

When the level $V_4$ of the pin 4 is greater than the sum of the level $V_3$ of the pin 3 and the threshold $V_g$ (i.e. $V_4>V_3+V_g$), the triode Ta is in an ON state, a high level signal is output by the comparator C2 of the second switching module, a low level signal is received by the Sel1 pin of the first switching module, which indicates the pin 4 is the MIC pin and the pin 3 is the GND pin.

The threshold $V_g$ is greater than or equal to 0. In the embodiment, the threshold $V_g$ may be a breakover voltage of the triode Ta, such as 0.3V or 0.7V.

The first switching module connects the B0L pin to the pin A according to the low level signal received by the Sel1 pin, such that the pin 3 of the audio interface is connected to the ground.

When a low level signal is received by the Sel1 pin of the first switching module, the first switching module connects the B0L pin to the pin A, i.e. the B0L pin/the pin 3 of the audio interface is connected to the ground.

The second switching module connects the B0L pin to the pin A according to the low level signal received by the Sel2 pin, such that the pin 4 of the audio interface is connected to the ground.

When a low level signal is received by the Sel2 pin of the second switching module, the second switching module connects the B0L pin to the pin A, i.e. the B0L pin/the pin 4 of the audio interface is connected to the ground.

According to the basic principle of the present invention, various variations may be made to the embodiment described above, for example:

1) changing the connection between the pin 3 of the audio interface and other components and the connection between the pin 4 of the audio interface and other components;
2) connecting the pin 4 of the audio interface to the B1H instead of the B0L of the first switching module, and connecting the pin 3 of the audio interface to the B1H instead of the B0L of the second switching module.

Embodiment 14

Figure 14:
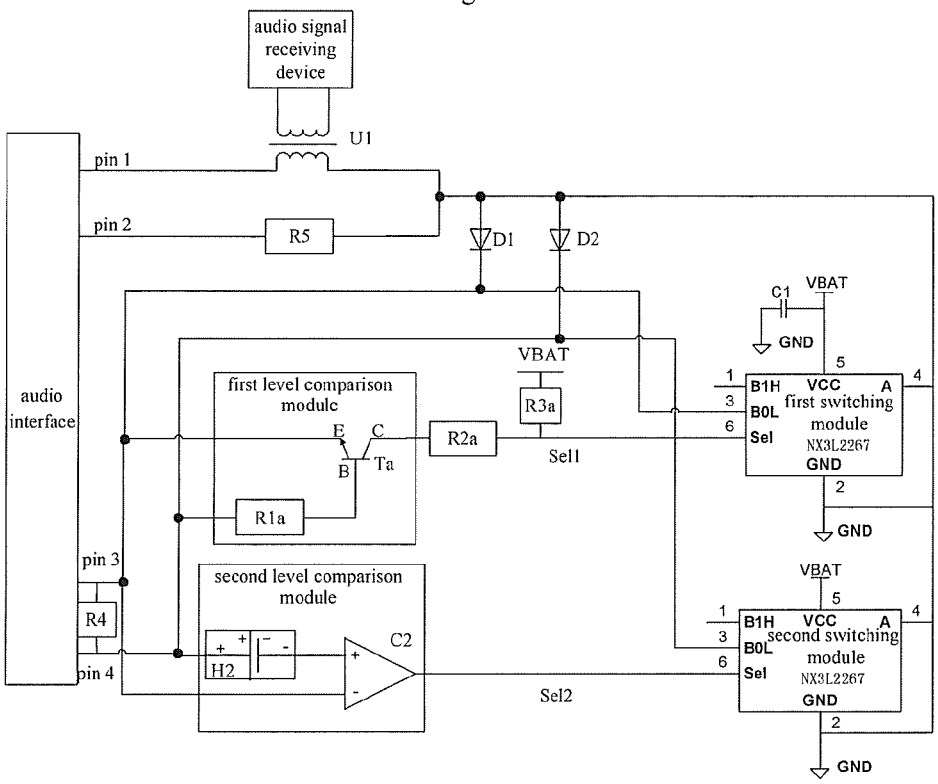
FIG. 14 is a schematic view of an audio interface self-adaption device according to a fourteenth embodiment of the present disclosure.

FIG. 14 is a schematic view of an audio interface self-adaption device according to a fourteenth embodiment of the present disclosure. As shown in FIG. 14, the differences between the present embodiment and the Embodiment 13 are as follows.

(1) The pin 1 of the audio interface is connected to the pin 3 of the audio interface via a device having unidirectional conductivity (referred as a unidirectional conductive component hereinafter, such as a diode, a triode, a MOS, and so on), the pin 1 of the audio interface is connected to the pin 4 of the audio interface via a device having unidirectional conductivity (referred as a unidirectional conductive component hereinafter, such as a diode, a triode, a MOS, and so on), the pin 2 of the audio interface is connected to the pin 3 of the audio interface via a device having unidirectional conductivity (referred as a unidirectional conductive component hereinafter, such as a diode, a triode, a MOS, and so on), and the pin 2 of the audio interface is connected to the pin 4 of the audio interface via a device having unidirectional conductivity (referred as a unidirectional conductive component hereinafter, such as a diode, a triode, a MOS, and so on).

For example, as shown in FIG. 14, the pin 1 of the audio interface is connected to the pin 3 of the audio interface via a diode D1, the pin 2 of the audio interface is connected to the pin 3 of the audio interface via the diode D1, the pin 1 of the audio interface is connected to the pin 4 of the audio interface via a diode D2, and the pin 2 of the audio interface is connected to the pin 4 of the audio interface via the diode D2.

(2) The pin 3 and the pin 4 of the audio interface are connected via a resistor R4.

The resistance of the resistor R4 is greater than 1KΩ, and the resistance of the resistor R4 of the embodiment may be from 1KΩ to 20KΩ.

In the embodiment with the above additional technical features, the audio interface self-adaption device can be connected to an audio signal sending device with any type of audio interface, and pass a detection conducted by the audio signal sending device successfully.

Embodiment 15

Figure 15:
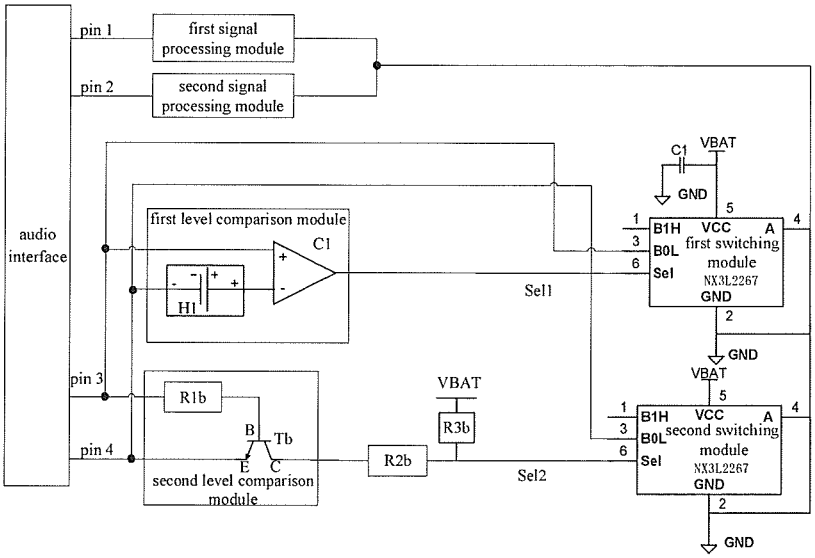
FIG. 15 is a schematic view of an audio interface self-adaption device according to a fifteenth embodiment of the present disclosure.

FIG. 15 is a schematic view of an audio interface self-adaption device according to a fifteenth embodiment of the present disclosure. As shown in FIG. 15, the audio interface self-adaption device of the embodiment comprises: an audio interface, a first level comparison module, a second level comparison module, a power output terminal VBAT, a first switching module, a second switching module, resistor R2*b*, resistor R3*b*, and so on.

The first level comparison module comprises a first reference voltage module H1 and a comparator C1.

The pin 3 is connected to a positive electrode of the comparator C1. The pin 4 is connected to a negative electrode of the comparator C1 via the first reference voltage module H1, i.e. the pin 4 is connected to a negative electrode of the first reference voltage module H1, and a positive electrode of the first reference voltage module H1 is connected to the negative electrode of the comparator C1.

In the embodiment, the first reference voltage module H1 may be a power, and the power has a positive electrode being the positive electrode of the first reference voltage module H1 and a negative electrode being the negative electrode of the first reference voltage module H1. The voltage provided by the first reference voltage module H1 is a threshold $V_g$.

In other embodiments of the present disclosure, the first reference voltage module H1 may be a component which can supply a reference voltage (threshold voltage), such as a diode connected to the power.

An output pin of the comparator C1 is connected to a signal input pin (Sel1) of the first switching module.

The second level comparison module comprises a NPN triode Tb.

A base (B) of the triode Tb is connected to the pin 3, an emitter (E) of the triode Tb is connected to the pin 4, a collector (C) of the triode Tb is connected to a signal input pin (Sel2) of the second switching module via the resistor R2*b*, and the collector (C) of the triode Tb is connected to the power output terminal VBAT via the resistor R2*b* and the resistor R3*b*.

Moreover, the base (B) of the triode Tb and the pin 3 may be connected via a resistor R1*b*.

If an ordinary battery is used as the power, the voltage output by the power is generally from 2.7 to 4.2V.

A B0L pin of the first switching module is connected to the pin 3 of the audio interface, a B0L pin of the second switching module is connected to the pin 4 of the audio interface, a ground pin (GND pin) of the first switching module is connected to the ground, a ground pin (GND pin) of the second switching module is connected to the ground, a pin A of the first switching module and is connected to the ground, a pin A of the second switching module and is connected to the ground, the pin A of the first switching module and is connected to the pin 1 and the pin 2 of the audio interface respectively, and the pin A of the second switching module and is connected to the pin 1 and the pin 2 of the audio interface respectively.

Furthermore, the pin 1 of the audio interface may be connected to a ground wire via a first signal processing module, and the pin 2 of that may be connected to the ground wire via a second signal processing module.

Each of the first signal processing module and the second signal processing module may comprise at least one selected from a group consisting of: a resistor, a louder speaker, a transformer, and a signal processing module comprising a resistor and a comparator connected in parallel.

In the embodiment, when a level $V_3$ of the pin 3 is greater than a sum of a level $V_4$ of the pin 4 and a predetermined threshold $V_g$ (i.e. $V_3>V_4+V_g$), a high level signal is output by the comparator C1 of the first switching module, the triode Tb is in an ON state, a low level signal is received by the Sel2 pin of the second switching module, which indicates the pin 3 is the MIC pin and the pin 4 is the GND pin.

When the level $V_4$ of the pin 4 is greater than the sum of the level $V_3$ of the pin 3 and a predetermined threshold $V_g$ (i.e. $V_4>V_3+V_g$), a low level signal is output by the comparator C1 of the first switching module, the triode Tb is in an OFF state, a low level signal is received by the Sel1 pin of the first switching module, which indicates the pin 4 is the MIC pin and the pin 3 is the GND pin.

The predetermined threshold $V_g$ is greater than or equal to 0. In the embodiment, the threshold $V_g$ may be a breakover voltage of the triode Ta, such as 0.3V or 0.7V.

The first switching module connects the B0L pin to the pin A according to the low level signal received by the Sel1 pin, such that the pin 3 of the audio interface is connected to the ground.

When a low level signal is received by the Sel1 pin of the first switching module, the first switching module connects the B0L pin to the pin A, i.e. the B0L pin/the pin 3 of the audio interface is connected to the ground.

The second switching module connects the B0L pin to the pin A according to the low level signal received by the Sel2 pin, such that the pin 4 of the audio interface is connected to the ground.

When a low level signal is received by the Sel2 pin of the second switching module, the second switching module connects the B0L pin to the pin A, i.e. the B0L pin/the pin 4 of the audio interface is connected to the ground.

According to the basic principle of the present invention, various variations may be made to the embodiment described above, for example:

1) changing the connection between the pin 3 of the audio interface and other components and the connection between the pin 4 of the audio interface and other components;
2) connecting the pin 4 of the audio interface to the B1H instead of the B0L of the first switching module, and connecting the pin 3 of the audio interface to the B1H instead of the B0L of the second switching module.

Embodiment 16

Figure 16:
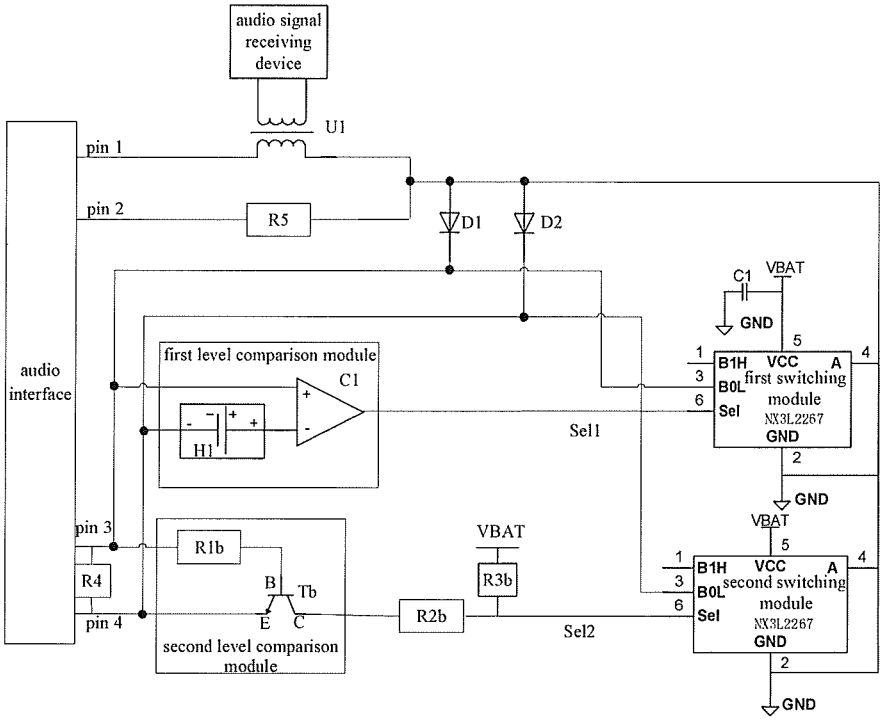
FIG. 16 is a schematic view of an audio interface self-adaption device according to a sixteenth embodiment of the present disclosure.

FIG. 16 is a schematic view of an audio interface self-adaption device according to a sixteenth embodiment of the present disclosure. As shown in FIG. 16, the differences between the present embodiment and Embodiment 15 are as follows.

(1) The pin 1 of the audio interface is connected to the pin 3 of the audio interface via a unidirectional conductive component (such as a diode, a triode, a MOS, and so on), the pin 1 of the audio interface is connected to the pin 4 of the audio interface via a unidirectional conductive component (such as a diode, a triode, a MOS, and so on), the pin 2 of the audio interface is connected to the pin 3 of the audio interface via a unidirectional conductive component (such as a diode, a triode, a MOS, and so on), and the pin 2 of the audio interface is connected to the pin 4 of the audio interface via a unidirectional conductive component (such as a diode, a triode, a MOS, and so on).

For example, as shown in FIG. 16, the pin 1 of the audio interface is connected to the pin 3 of the audio interface via a diode D1, the pin 2 of the audio interface is connected to the pin 3 of the audio interface via the diode D1, the pin 1 of the audio interface is connected to the pin 4 of the audio interface via a diode D2, and the pin 2 of the audio interface is connected to the pin 4 of the audio interface via the diode D2.

(2) The pin 3 and the pin 4 of the audio interface are connected via a resistor R4.

The resistance of the resistor R4 is greater than 1KΩ, and the resistance of the resistor R4 of the embodiment may be from 1KΩ to 20KΩ.

In the embodiment with the above additional technical features, the audio interface self-adaption device can be connected to an audio signal sending device with any type of audio interface, and pass a detection conducted by the audio signal sending device successfully.

Embodiment 17

Figure 17:
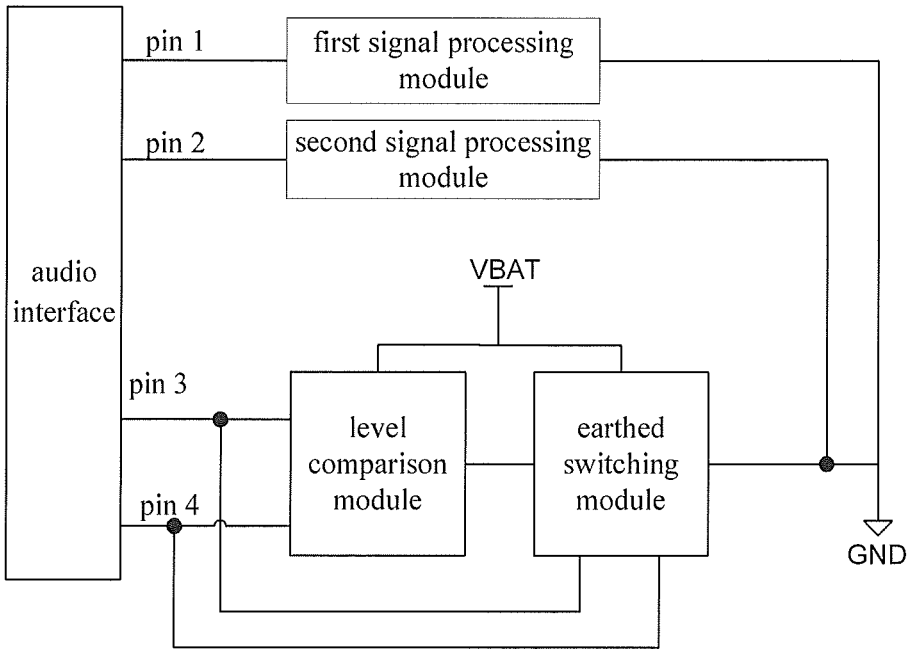
FIG. 17 is a schematic view of an audio interface self-adaption device according to a seventeenth embodiment of the present disclosure.

FIG. 17 is a schematic view of an audio interface self-adaption device according to a seventeenth embodiment of the present disclosure. As shown in FIG. 17, the audio interface self-adaption device of the embodiment comprises: an audio interface, a level comparison module, a power output terminal VBAT, an earthed switching module, and so on.

The level comparison module is configured to detect levels of the pin 3 and the pin 4 of the audio interface and to output a control instruction for controlling the earthed switching module according to the detected levels.

Furthermore, the level comparison module comprises the first level comparison module and the second comparison module according to any of the Embodiments 1-16.

Of course, the level comparison module of the embodiment may be a module which integrates all the functions of the first level comparison and the second comparison module.

The power output terminal VBAT is configured to supply power for all modules. If an ordinary battery is used as the power, the voltage output by the power is generally from 2.7V to 4.2V.

The earthed switching module is configured to connect a GND pin being the pin 3 or the pin 4 of the audio interface to the ground according to the control instruction output by the level comparison module.

Furthermore, the earthed switching module comprises the switching module according to any of the Embodiments 1-8 and an external circuit (comprising a PNP triode Tc); or the earthed switching module comprises the first switching module and the second switching module according to any of the Embodiments 9-16.

Furthermore, the pin 1 of the audio interface may be connected to a ground wire via a first signal processing module and the pin 2 of the audio interface may be connected to the ground wire via a second signal processing module.

Each of the first signal processing module and the second signal processing module may comprise at least one selected from a group consisting of: a resistor, a louder speaker, a transformer, and a signal processing module comprising a resistor and a comparator connected in parallel.

In the embodiment, when a level $V_3$ of the pin 3 is greater than a sum of a level $V_4$ of the pin 4 and a predetermined threshold $V_g$ (i.e. $V_3>V_4+V_g$), the level comparison module determines the level of the pin 3 is higher than the level of the pin 4 by comparing the levels of the pin 3 and the pin 4, which indicates the pin 4 is the GND pin, then the earthed switching module connects the pin 4 to the ground, and the earthed switching module connects the GND pin to a switching pin which is connected to the pin 4.

When a level $V_4$ of the pin 4 is greater than a sum of a level $V_3$ of the pin 3 and a predetermined threshold $V_g$ (i.e. $V_4>V_3+V_g$), the level comparison module determines the level of the pin 4 is higher than the level of the pin 3 by comparing levels of the pin 4 and the pin 3, which indicates the pin 3 is the GND pin, then the earthed switching module connects the pin 3 to the ground, and the earthed switching module connects the GND pin to the switching pin which is connected to the pin 3.

The threshold $V_g$ is greater than or equal to 0. In the embodiment, the threshold $V_g$ may be a breakover voltage of the triode Ta, such as 0.3V or 0.7V.

Embodiment 18

Figure 18:
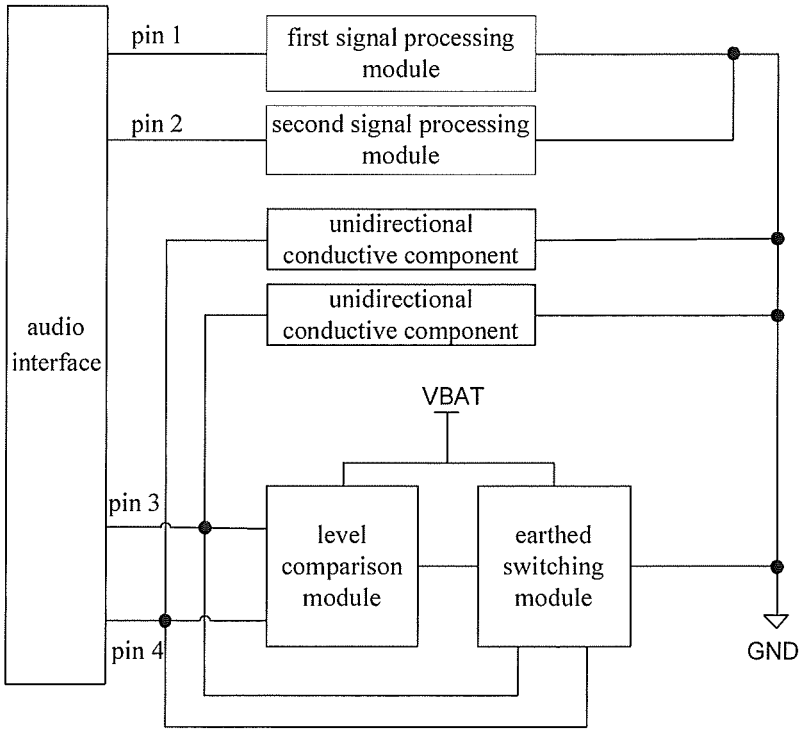
FIG. 18 is a schematic view of an audio interface self-adaption device according to an eighteenth embodiment of the present disclosure.

FIG. 18 is a schematic view of an audio interface self-adaption device according to an eighteenth embodiment of the present disclosure. As shown in FIG. 18, the differences between the present embodiment and the Embodiment 17 are as follows.

(1) The pin 1 of the audio interface is connected to the pin 3 of the audio interface via a unidirectional conductive component (such as a diode, a triode, a MOS, and so on), the pin 1 of the audio interface is connected to the pin 4 of the audio interface via a unidirectional conductive component (such as a diode, a triode, a MOS, and so on), the pin 2 of the audio interface is connected to the pin 3 of the audio interface via a unidirectional conductive component (such as a diode, a triode, a MOS, and so on), and the pin 2 of the audio interface is connected to the pin 4 of the audio interface via a unidirectional conductive component (such as a diode, a triode, a MOS, and so on).

For example, as shown in FIGS. 2, 4, 6, 8, 10, 12, 14, 16 of the above embodiments, the pin 1 of the audio interface is connected to the pin 3 of the audio interface via a diode D1, the pin 2 of the audio interface is connected to the pin 3 of the audio interface via the diode D1, the pin 1 of the audio interface is connected to the pin 4 of the audio interface via a diode D2, and the pin 2 of the audio interface is connected to the pin 4 of the audio interface via the diode D2.

(2) The pin 3 and the pin 4 of the audio interface are connected via a resistor R4.

As shown in FIGS. 2, 4, 6, 8, 10, 12, 14, 16 of the above embodiments, the resistance of the resistor R4 is greater than 1KΩ, and the resistance of the resistor R4 of the embodiment may be from 1KΩ to 20KΩ.

In the embodiment with the above additional technical features, the audio interface self-adaption device can be connected to an audio signal sending device with any type of audio interface, and pass a detection conducted by the audio signal sending device successfully.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An audio interface self-adaption device, comprising an audio interface, the audio interface comprising a pin 1, a pin 2, a pin 3, and a pin 4, one of the pin 3 and the pin 4 being a microphone pin of the audio interface, and the other one of the pin 3 and the pin 4 being a ground pin, wherein the device further comprises a first level comparison module, a second level comparison module, a PNP triode Tc, a power output terminal VBAT, a switching module, a resistor R2*a*, and a resistor R2*b*, wherein the first level comparison module comprises a NPN triode Ta, and the NPN triode Ta comprises a base connected to a first pin, an emitter connected to a second pin, and a collector connected to a base of the PNP triode Tc via the resistor R2*a;* the second level comparison module comprises a NPN triode Tb, and the NPN triode Tb comprises a base connected to the second pin, an emitter connected to the first pin, and a collector connected to a signal input pin Sel of the switching module and connected to the base of the PNP triode Tc via the resistor R2*b;* an emitter of the PNP triode Tc is connected to the power output terminal VBAT, and a collector of the PNP triode Tc is connected to a power input pin VCC of the switching module;

a first input pin B0L of the switching module is connected to the first pin, a second input pin B1H of the switching module is connected to the second pin, and an output pin of the switching module is connected to the ground;

the switching module is configured to connect one of the first input pin B0L and the second input pin B1H to the output pin of the switching module according to a level of a signal received by the signal input pin Sel;

an audio pin being the pin 1 and/or the pin 2 of the audio interface is connected to a ground wire; and the first pin is one of the pin 3 and the pin 4 of the audio interface, and the second pin is the other one of the pin 3 and the pin 4 of the audio interface.

2. The device according to claim 1, wherein the device further comprises a first unidirectional conductive component, a second unidirectional conductive component, and a resistor R4;

the audio pin is connected to the pin 3 via the first unidirectional conductive component, and the audio pin is connected to the pin 4 via the second unidirectional conductive component;

a conducting direction of the first unidirectional conductive component is from the audio pin to the pin 3, and a conducting direction of the second unidirectional conductive component is from the audio pin to the pin 4; and the pin 3 and the pin 4 of the audio interface are connected via the resistor R4.

3. The device according to claim 2, wherein the audio pin comprises the pin 1 and the pin 2 of the audio interface;

the pin 1 is connected to the first unidirectional conductive component via a first signal processing module, the first unidirectional conductive component is connected to the pin 3, and the pin 1 is connected to the pin 4 via the first signal processing module and the second unidirectional conductive component; and the pin 2 is connected to the first unidirectional conductive component via a second signal processing module, the first unidirectional conductive component is connected to the pin 3, and the pin 2 is connected to the pin 4 via the second signal processing module and the second unidirectional conductive component.

4. The device according to claim 2, wherein the first unidirectional conductive component comprises one selected from a group consisting of: a diode, a triode, and a MOS; and the second unidirectional conductive component comprises one selected from a group consisting of: a diode, a triode, and a MOS.

5. The device according to claim 3, wherein the first signal processing module comprises at least one selected from a group consisting of: a resistor, a microphone, a transformer, a resistor, and a comparator connected in parallel, and a resistor and an operational amplifier connected in parallel; and the second signal processing module comprises at least one selected from a group consisting of: a resistor, a microphone, a transformer, a resistor and a comparator connected in parallel, and a resistor and an operational amplifier connected in parallel.

6. The device according to claim 1, wherein the audio interface is a headphone plug or a headphone jack.

7. The device according to claim 3, wherein the first unidirectional conductive component comprises one selected from a group consisting of: a diode, a triode, and a MOS; and the second unidirectional conductive component comprises one selected from a group consisting of: a diode, a triode, and a MOS.

* * * * *